US007907875B2

(12) United States Patent
Sato

(10) Patent No.: US 7,907,875 B2
(45) Date of Patent: Mar. 15, 2011

(54) DEVELOPER CARTRIDGE AND DEVELOPING DEVICE

(75) Inventor: Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 445 days.

(21) Appl. No.: 12/040,120

(22) Filed: Feb. 29, 2008

(65) Prior Publication Data

US 2008/0212997 A1 Sep. 4, 2008

(30) Foreign Application Priority Data

Mar. 1, 2007 (JP) ..... 2007-051422

(51) Int. Cl.
*G03G 15/06* (2006.01)
*G03G 15/08* (2006.01)

(52) U.S. Cl. ..... 399/262; 399/110; 399/111; 399/258; 399/263

(58) Field of Classification Search ..... 399/25, 399/110, 111, 114, 258, 260, 262, 263
See application file for complete search history.

(56) References Cited

U.S. PATENT DOCUMENTS

| | | | | |
|---|---|---|---|---|
| 5,608,501 | A | 3/1997 | Makino | |
| 5,771,427 | A * | 6/1998 | Makino | 399/120 |
| 6,088,556 | A * | 7/2000 | Nagasaki et al. | 399/120 |
| 6,188,859 | B1 * | 2/2001 | Wang et al. | 399/262 |
| 6,591,079 | B2 * | 7/2003 | Ota et al. | 399/262 |
| 7,149,462 | B2 * | 12/2006 | Kawamura et al. | 399/262 |
| 7,643,777 | B2 * | 1/2010 | Matsumoto et al. | 399/262 |

FOREIGN PATENT DOCUMENTS

| | | | |
|---|---|---|---|
| JP | 01314279 | A * | 12/1989 |
| JP | 05-119621 | | 5/1993 |
| JP | 07-225514 | | 8/1995 |
| JP | 08-171276 | | 7/1996 |
| JP | 2001134060 | A * | 5/2001 |
| JP | 2004157254 | A * | 6/2004 |

* cited by examiner

*Primary Examiner* — David M Gray
*Assistant Examiner* — Fred Braun
(74) *Attorney, Agent, or Firm* — Banner & Witcoff, Ltd.

(57) ABSTRACT

A developer cartridge includes a cartridge cabinet configured to accommodate developer. The cartridge cabinet includes a cartridge-side opening that allows communication between an inside of the cartridge cabinet and an outside of the cartridge cabinet, and a slope provided at a lower edge of the cartridge-side opening, the slope inclining in a direction crossing a horizontal direction when the cartridge-side opening is oriented in a horizontal direction.

12 Claims, 13 Drawing Sheets

DEVELOPER CARTRIDGE AND DEVELOPING DEVICE

CROSS-REFERENCE TO RELATED APPLICATIONS

This application claims priority from Japanese Patent Application No. 2007-051422 filed on Mar. 1, 2007, the entire subject matter of which is incorporated herein by reference.

TECHNICAL FIELD

Aspects of the present invention relate to a developing device attached to an image forming apparatus and a developer cartridge.

BACKGROUND

There has been proposed an image forming apparatus such as a laser printer, in which a developer cartridge detachably attached to a developing cabinet of a developing device.

For example, JP-A-7-225514 discloses a configuration in which a developer cartridge is detachably attached to a casing of a developing device.

A first opening is formed in the developer cartridge, and a second opening is formed in the casing of the developing device. When the developer cartridge is attached to the casing of the developing device to bring the first and second openings into mutual communication, toner accommodated in the developer cartridge can be supplied to the developing device by way of the first and second openings.

SUMMARY

Aspects of the present invention provide a developer cartridge and a developing device which enable reliable prevention of leakage of developer.

DETAILED DESCRIPTION

<General Overview>

Figure 1:
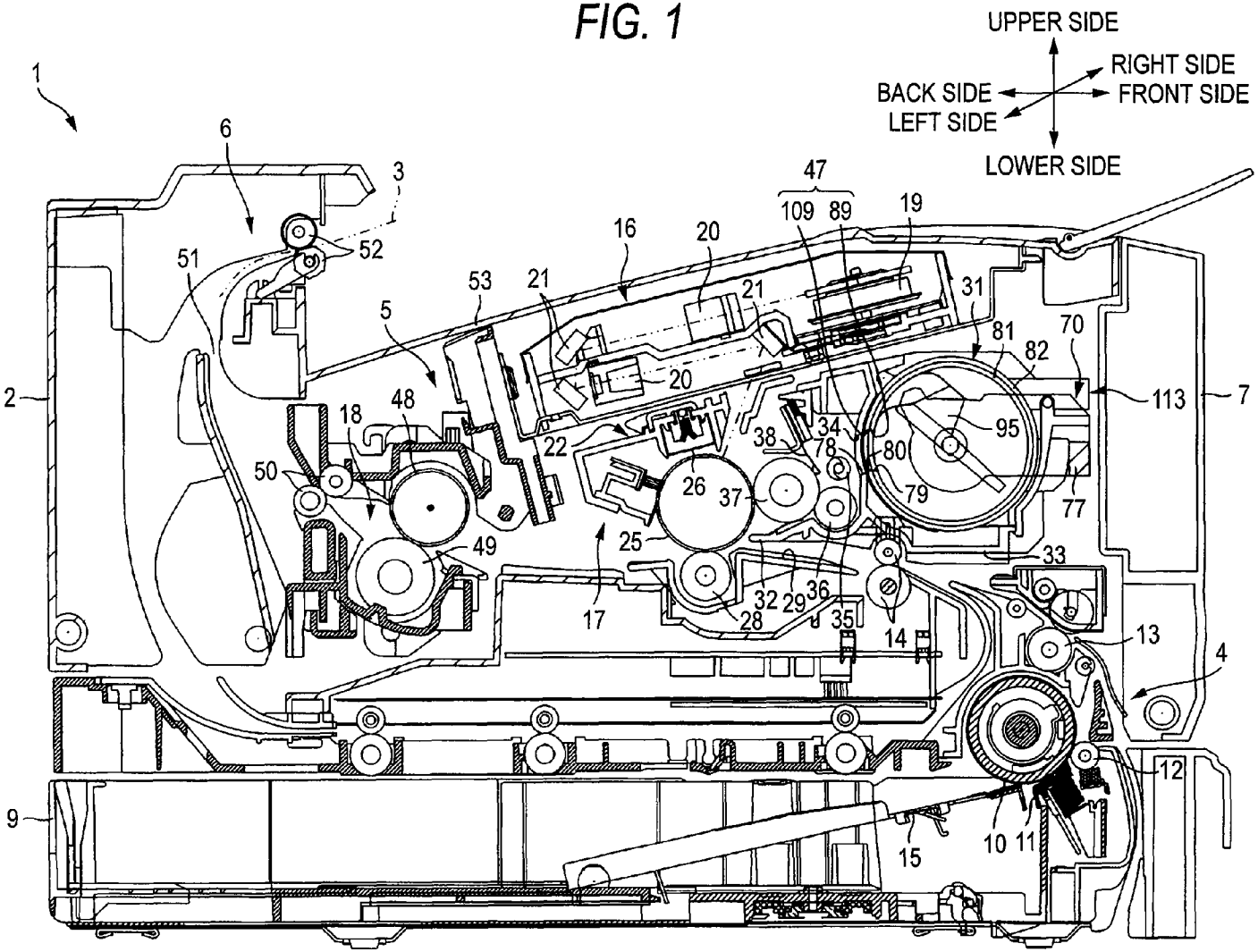
FIG. 1 is an exemplary side sectional view of an image forming apparatus according to an aspect of the present invention.

According to an aspect of the present invention, there is provided a developer cartridge including: a cartridge cabinet configured to accommodate developer, the cartridge cabinet including: a cartridge-side opening that allows communication between an inside of the cartridge cabinet and an outside of the cartridge cabinet; and a slope provided at a lower edge of the cartridge-side opening, the slope inclining in a direction crossing a horizontal direction when the cartridge-side opening is oriented in a horizontal direction.

According to another aspect of the present invention, there is provided a developing device including: a developer cartridge including: a cartridge cabinet configured to accommodate developer, the cartridge cabinet including: a cartridge-side opening that allows communication between an inside of the cartridge cabinet and an outside of the cartridge cabinet; and a slope provided at a lower edge of the cartridge-side opening, the slope inclining in a direction crossing a horizontal direction when the cartridge-side opening is oriented in a horizontal direction; a developing cabinet, the developer cartridge being detachably attached to the developing cabinet, the developing cabinet including a developing-side opening located in a position opposed to the cartridge-side opening and configured to receive the developer; an open/close member that is operable to: close the developing-side opening by ascending operation; and open the developing-side openings by descending operation; and a developer carrier that is supported by the developing cabinet and carries the developer to a photosensitive member, wherein the developing cabinet further includes a slope at a lower edge of the developing-side opening, the slope inclining downwardly from an outside of the developing cabinet to an inside of the developing cabinet with respect to a horizontal direction when the developing-side opening is oriented in the horizontal direction.

According to still another aspect of the present invention, there is provided a developing device including: a developer cartridge including: a cartridge cabinet configured to accommodate developer, the cartridge cabinet including: a cartridge-side opening that allows communication between an inside of the cartridge cabinet and an outside of the cartridge cabinet; and a slope provided at a lower edge of the cartridge-side opening, the slope inclining in a direction crossing a horizontal direction when the cartridge-side opening is oriented in a horizontal direction; a developing cabinet including a developing-side opening that is locatable in a position opposed to the cartridge-side opening and is configured to receive the developer from the cartridge-side opening; and a developer carrier that is supported by the developing cabinet and carries the developer to a photosensitive member.

According to still another aspect of the present invention, there is provided a developing device including: a cartridge housing part to which a developer cartridge is detachably attached; a developing cabinet including a developing-side opening configured to receive developer supplied from the developer cartridge; an open/close member that is operable to: close the developing-side opening by ascending operation; and open the developing-side opening by descending operation; a developer carrier that is supported by the developing cabinet and is configured to supply the developer to a photosensitive member; and a slope provided at a lower edge of the developing-side opening, the slope inclining downwardly with respect to a horizontal direction from an outside of the developing cabinet to an inside of the developing cabinet when the developing-side opening is oriented in the horizontal direction.

<Illustrative Aspects>

Illustrative aspects of the invention will be described with reference to the drawings.

In the developer cartridge and the developing device disclosed in JP-A-7-225514, when the toner accommodated in the developer cartridge is supplied to the developing device, toner passes through the first and second openings. For this reason, when supply of toner is stopped, toner in the middle of passing through the first and second openings may stay at a lower edge of the first opening in the developer cartridge and a lower edge of an opening of the second opening in the developing device. When the developer cartridge is detached from the casing of the developing device in this state, the toner staying at the respective lower edges of the first and second openings may leak outside.

Aspects of the present invention provide a developer cartridge and a developing device which enable reliable prevention of leakage of developers (Image Forming Apparatus)

Figures 2A, 2B:
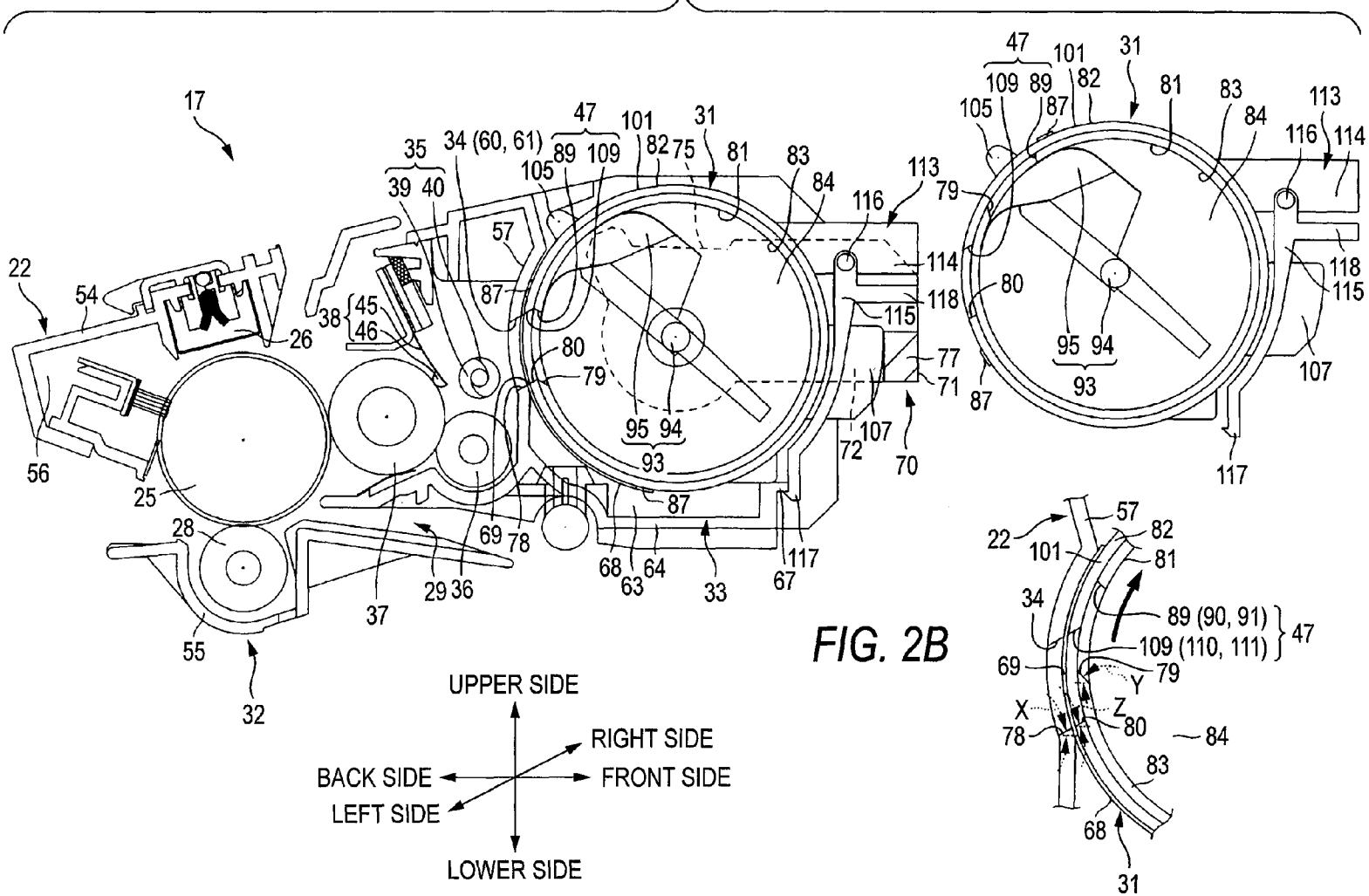
FIG. 2A is an exemplary side sectional view of a developing unit and a developer cartridge, wherein the developing unit is in a state in which the developer cartridge is attached to a process frame the developer cartridge.
FIG. 2B is a partial enlarged view of FIG. 2A.

FIG. 1 is an exemplary side sectional view showing an image forming apparatus according to an aspect of the present invention. In FIG. 1, the image forming apparatus is embodied in the form of a laser printer by way of an example. However, one of ordinary skill in the art will appreciate that the present inventive concept will apply equally to any apparatus which uses developer for producing images on a recording medium. FIG. 2A is an exemplary side sectional view of a developing unit and a developer cartridge, wherein the developing unit is in a state in which the developer cartridge is attached to a process frame the developer cartridge, and FIG. 2B is a partial enlarged view of FIG. 2A.

As shown in FIG. 1, the image forming apparatus 1 includes a feeder unit 4 for feeding a sheet 3 into a body casing 2, an image forming unit 5 for creating an image on the fed sheet 3, and a sheet discharge part 6 for discharging the sheet 3 with a formed image.

(1) Body Casing

The body casing 2 has a substantially box shape, and a clear aperture is formed in one sidewall of the casing, and a front cover 7 for opening or closing the clear aperture is provided. A developing unit 17 (described later) can be detachably attached to the body casing 2 by opening the front cover 7.

Incidentally, in the following description, a side (right side in FIG. 1) where the front cover 7 is provided is referred to as a front side (front face side) and an opposite side (left side in FIG. 1) is referred to as a back side (rear side). A proximal side of FIG. 1 in a thicknesswise direction of a sheet is referred to as a left side, and a distal side of FIG. 1 in the thicknesswise direction of the sheet is referred to as a right side. A horizontal direction is synonymous with a widthwise direction. Moreover, descriptions of the developing unit 17 and a developer cartridge 31 (described later) are provided with respect to a state where frame-side passage openings 34 and cartridge-side passage openings 47 (described later) are horizontally oriented.

(2) Feeder Unit

The feeder unit 4 includes a sheet feeding tray 9, a sheet feeding roller 10, a sheet feeding pad 11, paper dust removal rollers 12 and 13, a register roller 14, and a sheet pressing plate 15. The sheet 3 located at the topmost position on the sheet pressing plate 15 is fed one at a time by the sheet feeding roller 10 and the sheet feeding pad 11. After passing through the respective rollers 12 through 14, the sheet is conveyed to a transfer position (described later) of the image forming unit 5.

(3) Image Forming Unit

The image forming unit 5 includes a scanner unit 6, a developing unit 17 as one example of developing device, and a fixing part 18. In FIG. 1, the developing unit 17 is embodied in the form of a process cartridge by way of an example. However, one of ordinary skill in the art will appreciate that the present inventive concept will apply equally to any unit which may be used for developing.

(3-1) Scanner Unit

The scanner unit 16 is provided in an upper internal portion of the body casing 2. The scanner unit 16 includes a laser emission section (not shown), a polygon mirror 19 to be rotationally driven, and a plurality of lenses 20 and a plurality of reflection mirrors 21. As indicated by a chain line, a laser beam that is emitted from the laser emission section and that is based on image data is reflected by the polygon mirror 19, passes through or undergoes reflection on the plurality of lenses 20 and the plurality of reflection mirrors 21 in order to scan over the surface of a photosensitive drum 25 (described later) of the developing unit 17.

(3-2) Developing Unit

The developing unit 17 is disposed beneath the scanner unit 16 within the body casing 2, and is detachably attached to the body casing 2.

As shown in FIG. 2, the developing unit 17 has a process frame 22 and a developer cartridge 31. The process frame 22 as one example of developing cabinet includes a transfer path 29 for allowing passage of the sheet 3. The developer cartridge 31 is detachably attached to a cartridge housing part 33 (described later) of the process frame 22.

A vertically-extending partition wall 57 is provided at a substantially center position of the process frame 22 in a longitudinal direction thereof. A rear portion of the partition wall 57 is taken as a developing part 32, and a front portion of the partition wall 57 is taken as the foregoing cartridge housing part 33. The frame-side passage openings 34 are formed in the partition wall 57 as one example of developing-side openings.

The developing part 32 includes the photosensitive drum 25 as one example of photosensitive member, a scorotron-type charger 26, a transfer roller 28, an auger 35, a supply roller 36, a developing roller 37 as one example of developer carrier, and a layer thickness regulation blade 38 are provided in the developing part 32.

The photosensitive drum 25 is rotatably supported by the process frame 22. While being spaced apart from the photosensitive drum 25, the scorotron-type charger 26 is supported by the process frame 22 above the photosensitive drum 25. The transfer roller 28 is disposed opposite the photosensitive drum 25 from below and rotatably supported by the process frame 22. The developing roller 37 is longitudinal in the widthwise direction, as well as being disposed opposite and at the front of the photosensitive drum 25. The supply roller 36 is disposed opposite and at the front of the developing roller 37. The developing roller 37 and the supply roller 36 are rotatably supported by the process frame 22. The layer thickness regulation blade 38 has a leaf spring member 45 having a thin plate shape, and a pressure-contact rubber 46 provided at the lower end of the leaf spring member 45. The upper end of the leaf spring member 45 is fixed to the process frame 22, and the pressure-contact rubber 46 presses the surface of the developing roller 37 by elastic force of the leaf spring 45. The auger 35 is disposed opposite the frame-side passage openings 34 at the rear of the frame-side passage openings 34. The auger 35 has an auger shaft 39 and a screw 40 provided around the auger shaft 39. The auger shaft 39 is disposed in such a way that the axial center of the auger shaft extends along the widthwise direction, as well as being rotatably supported by the process frame 22 at a position above the supply roller 36

The developer cartridge 31 is detachably attached to the process frame 22 at the cartridge housing part 33. The developer cartridge 31 has a substantially cylindrical shape. The developer cartridge 31 includes the cartridge-side passage openings 47 (described later) as one example of cartridge-side openings for enabling communication between an inside of the developer cartridge 31 and an outside of the developer cartridge 31.

An agitator 93 (described later) is provided in the developer cartridge 31. Further, the developer is accommodated in the developer cartridge 31. In the image forming apparatus 1 of the aspect, the developer comprises a suspension polymerization toner which is a nonmagnetic one-component toner with positive electrification.

The developer in the developer cartridge 31 is agitated by rotation of the agitator 93 and subsequently received by the frame-side passage openings 34, to thus become discharged to the inside of the developing part 32. The discharged developer is supplied to the supply roller 36 while being conveyed, by rotation of the auger 35, from the center to respective ends in the widthwise direction. Some of the developer is returned to the inside of the developer cartridge 31 by way of the frame-side passage openings 34 and the cartridge-side passage openings 47. As a result, circulation of the developer between the developer cartridge 31 and the developing part 32 of the process frame is ensured.

The developer supplied to the supply roller 36 is supplied to the developing roller 37 by rotation of the supply roller 36. At this time, the developer is frictionally electrified with positive polarity between the supply roller 36 and the developing roller 37. Subsequently, the developer supplied to the developing roller 37 enters between the pressure-contact rubber 46 and the developing roller 37 in conjunction with rotation of the developing roller 37, and is carried as a thin layer on the surface of the developing roller 37 while being regulated between the rubber and the roller in terms of a layer thickness.

After being uniformly electrified with positive polarity by the scorotron-type charger 26 along with rotation of the photosensitive drum 25, the surface of the photosensitive drum 25 is exposed to a laser beam emitted from the scanner unit 16, whereupon an electrostatic latent image based on image data is formed. Subsequently, when the developer carried on the surface of the developing roller 37 comes into contact with the photosensitive drum 25 by rotation of the developing roller 37, the electrostatic latent image formed on the surface of the photosensitive drum 25 is supplied. As a result, the electrostatic latent image is developed (visualized), and the developer image is carried on the surface of the photosensitive drum 25. The developer image is transferred onto the sheet 3 conveyed (to a position) between the photosensitive drum 25 and the transfer roller 28.

(3-3) Fixing Part

As shown in FIG. 1, the fixing part 18 is provided at the rear of the developing unit 17. The fixing part 18 has a heating roller 48, a pressurizing roller 49 brought into intimate contact with the heating roller 48 from below, and a pair of conveyor rollers 50 disposed at the rear of these rollers.

The fixing part 18 thermally fixes the developer transferred on the sheet 3 at the transfer position during the course of the sheet 3 passing between the heating roller 48 and the pressurizing roller 49. Subsequently, the sheet 3 is conveyed to the sheet discharge part 6 by the pair of conveyor rollers 50.

(4) Sheet Discharge Part

The sheet discharge part 6 has a sheet discharging path 51, a sheet discharging roller 52, and a sheet discharging tray 53. The sheet 3 conveyed from the fixing part 18 to the sheet discharging path 51 is conveyed from the sheet discharging path 51 to the sheet discharging roller 52, and the sheet is discharged onto the sheet discharging tray 53 by the sheet discharging roller 52.

(Developing Unit)

Figure 3:
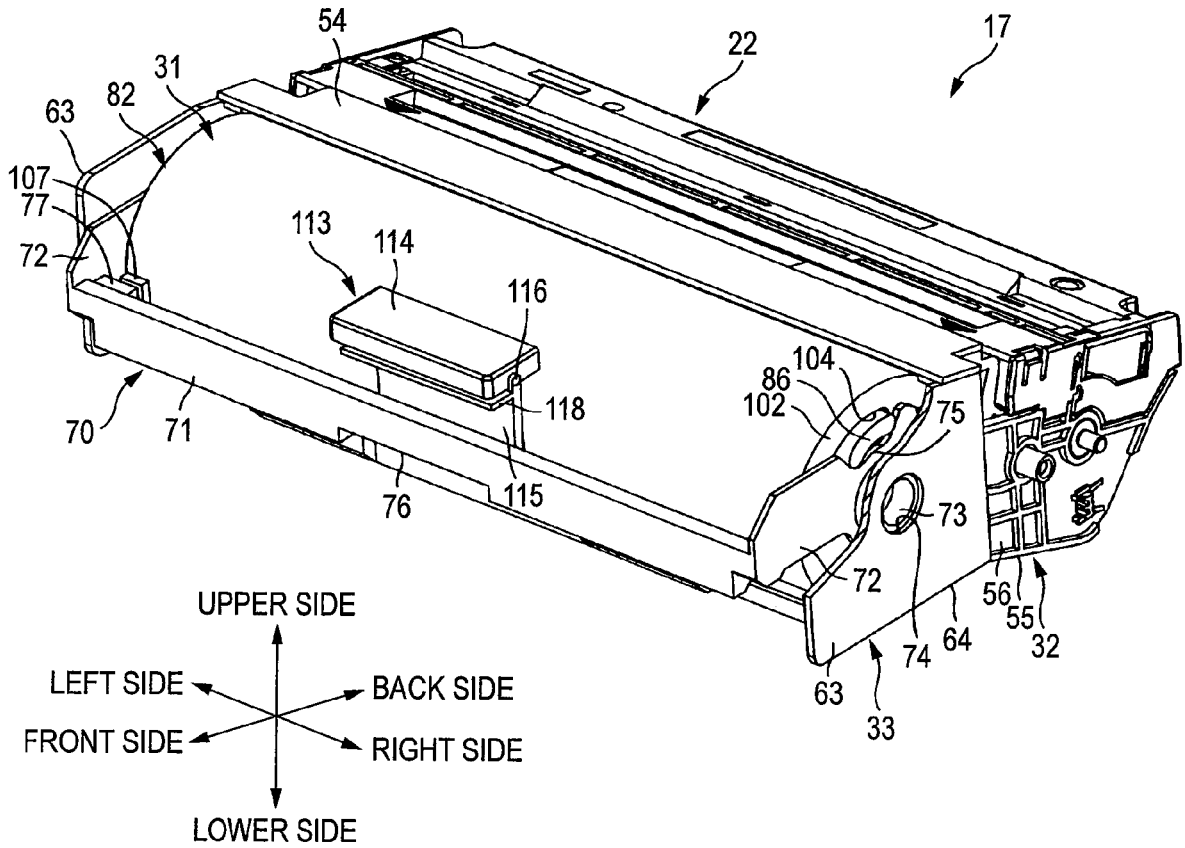
FIG. 3 is a schematic perspective view of the developing unit of FIG. 2 as viewed from a front right side of the developing unit.
Figure 4:
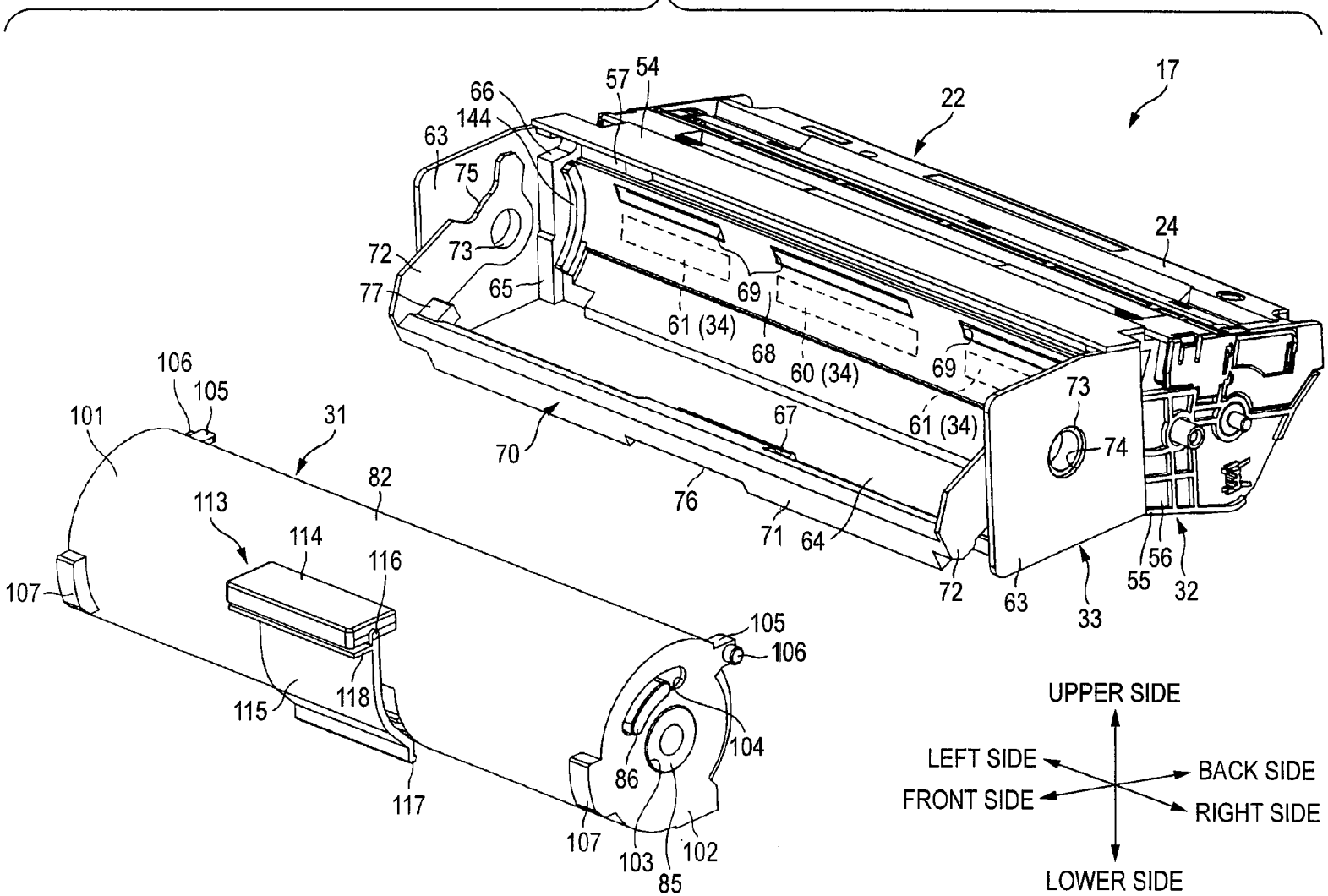
FIG. 4 is an exemplary perspective view, as viewed from the front right side of the developing unit of FIG. 3, showing the developing unit in a state in which the developer cartridge is detached from the process frame.
Figure 5:
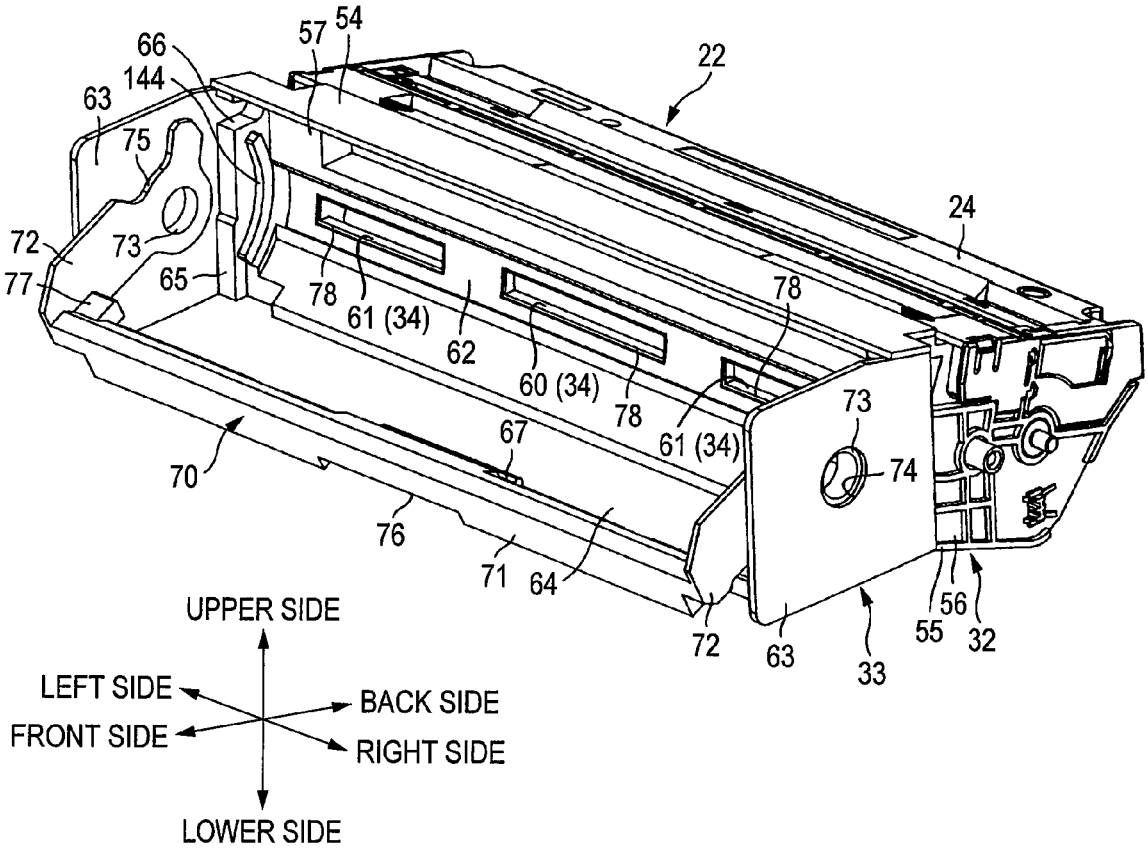
FIG. 5 is a schematic perspective view of the developing unit as viewed from the front right side.
Figure 6:
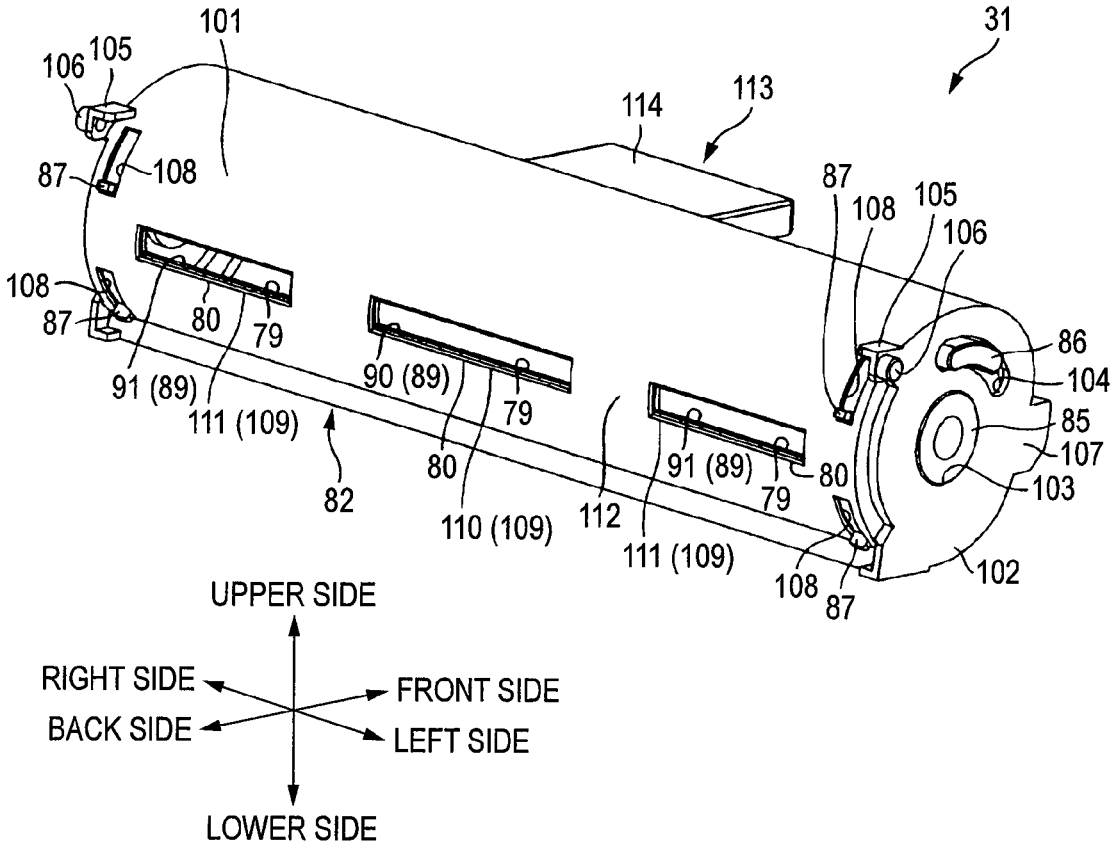
FIG. 6 is an exemplary perspective view of the developer cartridge of FIG. 4, as viewed from a back left side, in a state in which an inside cabinet is in an opened position.
Figure 7:
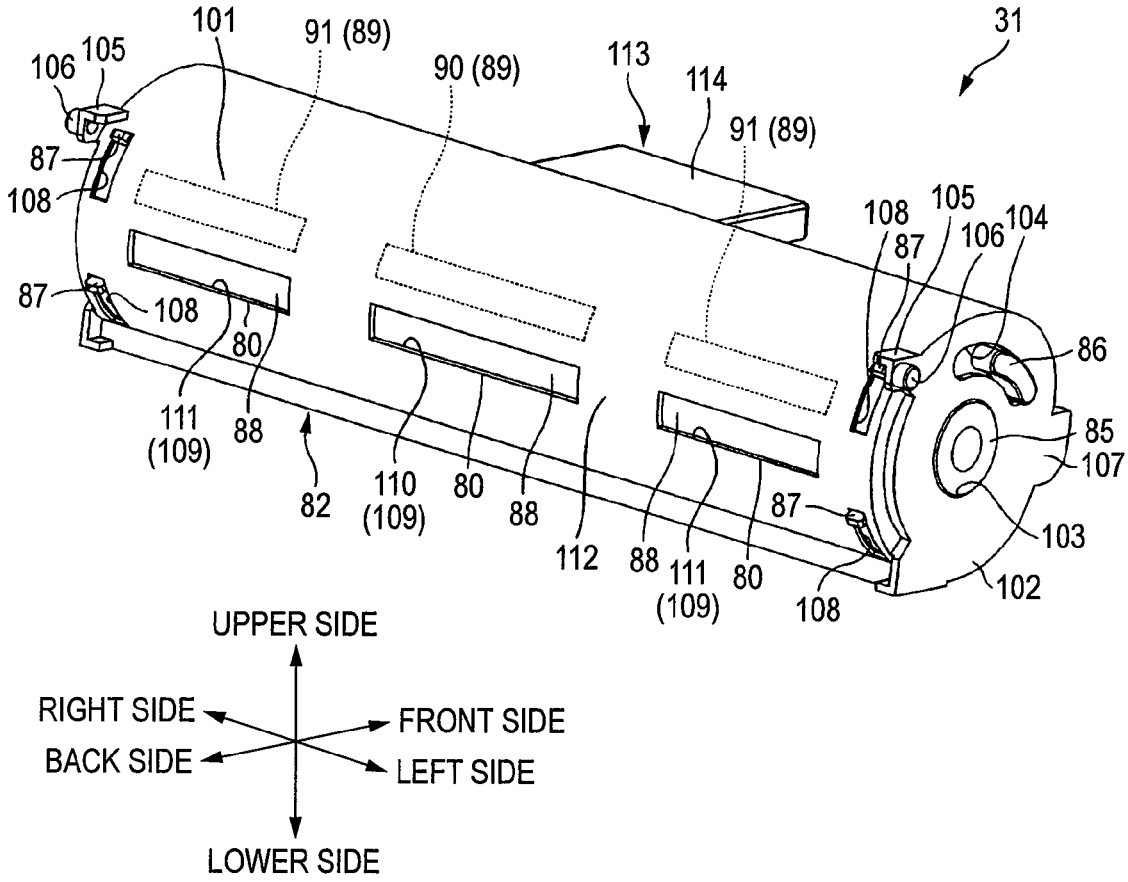
FIG. 7 is an exemplary perspective view of the developer cartridge of FIG. 4, as viewed from the back left side, in a state in which the inside cabinet is in a closed position.
Figure 8:
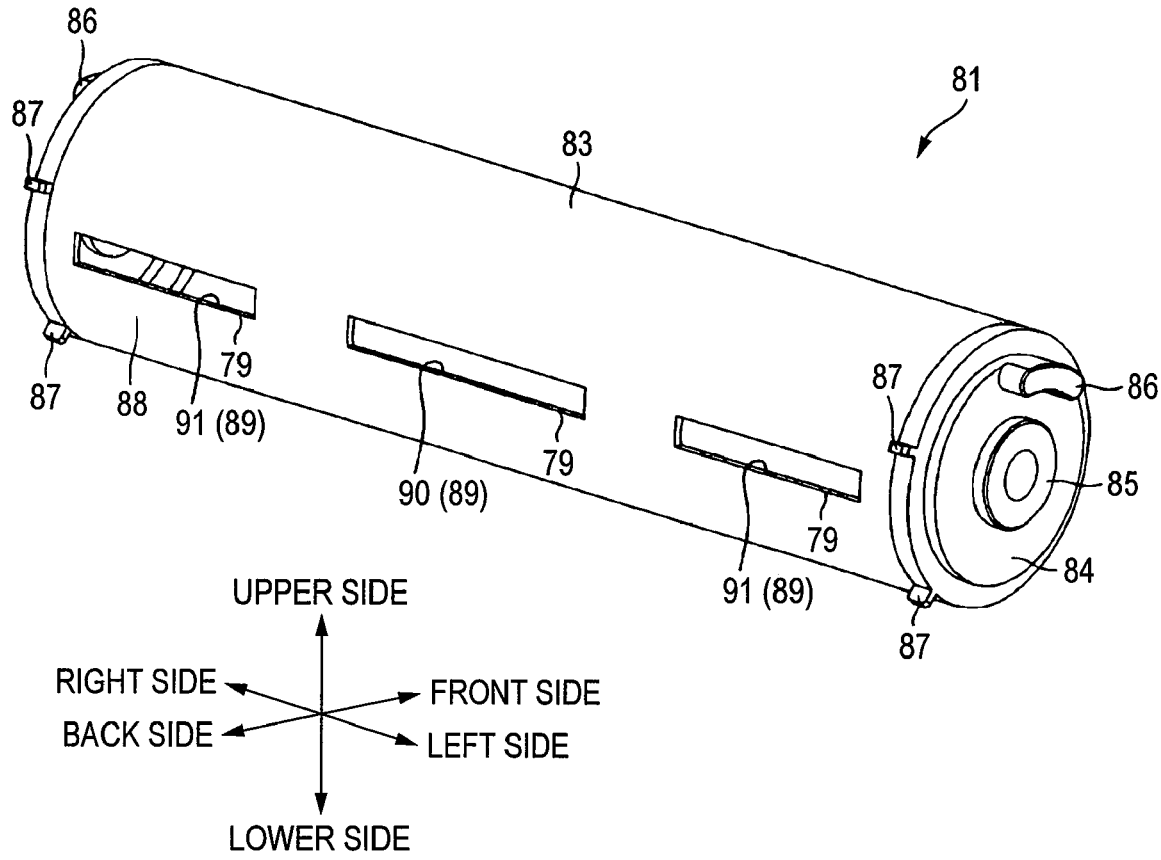
FIG. 8 is an exemplary perspective view, as viewed from a back left side, of the inside cabinet of the developer cartridge of FIG. 6.

FIG. 3 is a schematic perspective view of the developing unit of FIG. 2 as viewed from a front right side of the developing unit. FIG. 4 is an exemplary perspective view, as viewed from the front right side of the developing unit of FIG. 3, showing the developing unit in a state in which the developer cartridge is detached from the process frame. FIG. 5 is a schematic perspective view of the developing unit as viewed from the front right side. FIG. 6 is an exemplary perspective view of the developer cartridge of FIG. 4, as viewed from a back left side, in a state in which an inside cabinet is in an opened position. FIG. 7 is an exemplary perspective view of the developer cartridge of FIG. 4, as viewed from the back left side, in a state in which the inside cabinet is in a closed positions FIG. 8 is an exemplary perspective view, as viewed from a back left side, of the inside cabinet of the developer cartridge of FIG. 6.

(1) Process Frame

As shown in FIG. 2A, the process frame 22 integrally has the developing part 32 and the cartridge housing part 33.

(1-1) Developing Part

As shown in FIGS. 2A and 3, the developing part 32 integrally has an upper wall 54, a bottom wall 55, sidewalls 56, and a front wall 57. Both sidewalls 56 are disposed opposite each other while being spaced apart from each other in the widthwise direction. Each of the sidewalls 56 is arranged along a longitudinal direction.

The developing roller 37 is rotatably supported by front sections of both sidewalls 56, to thus be supported by the process frame 22.

The supply roller 36 is rotatably supported by the front sections of both sidewalls 56 at the front of the developing roller 37, to thus be supported by the process frame 22.

As a result of an auger shaft 39 being rotatably supported by the front sections of both sidewalls 56, the auger 35 is supported by the process frame 22 above the supply roller 36.

As shown in FIG. 2A, a curved portion extending along an outer peripheral surface of the developer cartridge 31 is formed in an intermediate area of the front wall 57 with respect to the vertical direction thereof.

As shown in FIG. 5, the frame-side passage opening 34 as one example of the developer passage opening is formed in a curved portion of the front wall 57.

Specifically, the frame-side passage opening 34 is formed in number of three while being spaced, at an interval, apart from each other in the widthwise direction. Each of the frame-side passage openings 34 has a substantially rectangular shape which is elongated in the widthwise direction. Of the frame-side passage openings 34, the frame-side passage opening 34 formed in the center of the front wall 57 in the widthwise direction thereof is taken as a frame-side feed opening 60, and the frame-side passage openings 34 on both sides of the frame-side feed opening 60 in the widthwise direction are taken as frame-side return openings 61.

Figure 11:
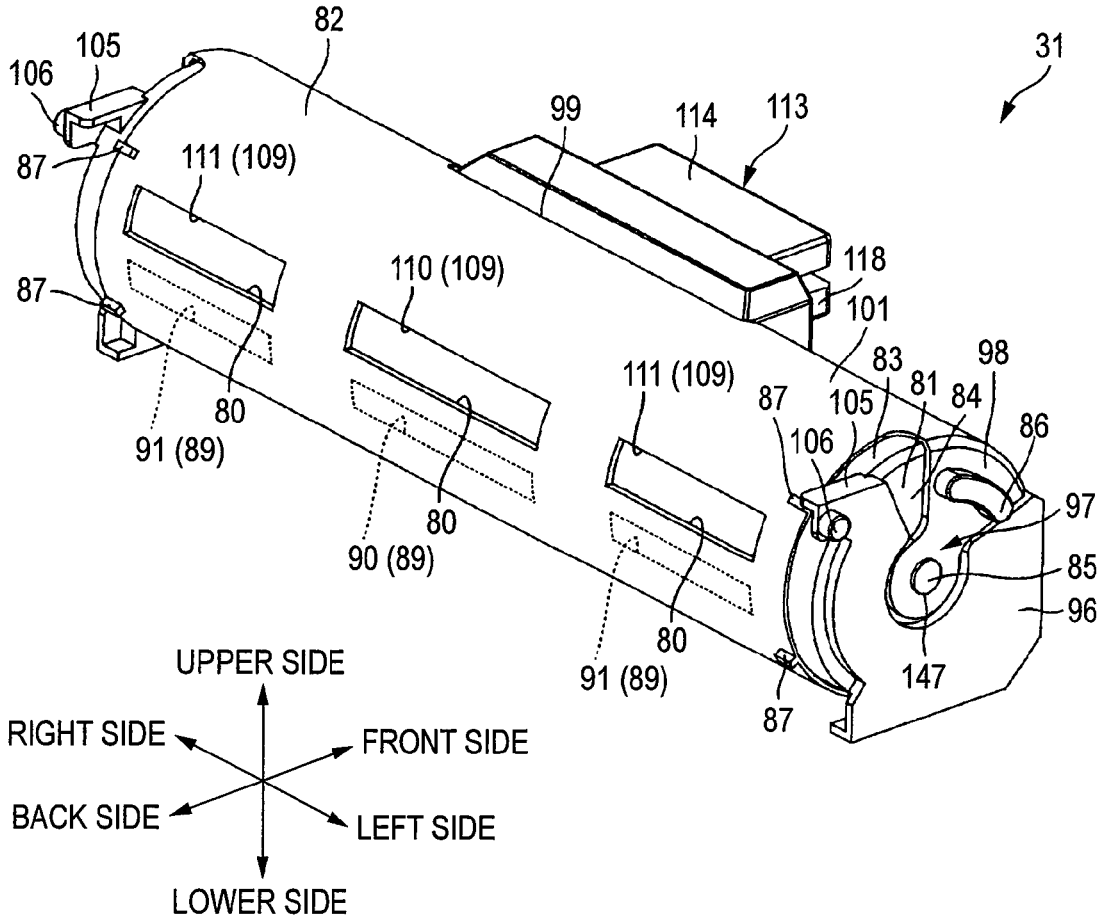
FIG. 11 is an exemplary perspective view of the developer cartridge of FIG. 9, as viewed from the back left sides in a state in which the outside cabinet is in a closed position.

As shown in FIG. 11, widthwise outer side edges of the frame-side return openings 61 are located inside (positions closer to the center in the widthwise direction) in the widthwise direction when compared with outer side edges of a roller portion of the supply roller 36.

Slopes (called frame-side slopes 78) are formed so as to extend over the entirety of each of the lower edges of the respective frame-side passage openings 34 (the frame-side supply openings 60 and the frame-side return openings 61) are formed in the partition wall 57. As shown in FIG. 2B, the frame-side slopes 78 are inclined downwardly along a direction crossing the horizontal direction, that is, a direction from the outside of the process frame 22 to the inside thereof. Provided that a tilt angle of the frame-side slopes 78 with respect to a horizontal plane is defined as X, the tilt angle X is set so as to become larger than an angle of repose of the developer (e.g., about 30° in the nonmagnetic one-component toner used in the image forming apparatus 1).

As shown in FIG. 5, a frame-side seal 62 for preventing leakage of the developer from the frame-side passage openings 34 is provided on the curved portion of the front wall 57 around the edges of the frame-side passage openings 34.

The frame-side seal 62 is formed, from an elastic material such as felt, in the form of a strip extending in the widthwise direction. Cutouts corresponding to the respective frame-side passage openings 34 are formed in the frame-side seal 62. The frame-side seal 62 is affixed to a position, which is located intermediate with respect to the vertical direction of the front wall 57, along the widthwise direction in such a way that the respective cutouts oppose the respective frame-side passage openings 34.

As a result, the frame-side seal 62 is provided on the surface (a front) of the curved portion of the front wall 57 so as to cover the edges of the respective frame-side passage openings 34 and become continuous among the respective frame-side passage openings 34. For the sake of convenience, the frame-side seal 62 is not shown in any drawings except FIG. 5

(1-2) Cartridge Housing Part

The cartridge housing part 33 has side plates 63 and a bottom plate 64. The side plates 63 and the bottom plate 64 of the cartridge housing part 33 are formed integrally so as to become continual from the bottom wall 55 and both side walls 56 of the developing part 32.

Shutter support sections 65 are provided on widthwise inner side walls of both side plates 63. Each of the shutter support sections 65 has a substantially rectangular shape bulging from the widthwise inner side walls of the side plates 63 to the inside, and vertically extends from the rear ends of the side plates 63.

A shutter guide section 144 is provided on the widthwise inner side surface of each of the shutter support sections 65. Each of the shutter guide sections 144 forms a convex line which bulges from the widthwise inner side surface of the shutter support section 65 to the inside, and is disposed opposite the curved portion of the front wall 57 with a nominal space therebetween in the longitudinal direction. Each of the shutter guide sections 144 has a substantially curved shape having substantially the same curvature as that of the curved portion of the front wall 57

The upper end surface of each of the shutter support sections 65 is positioned somewhat lower than the upper edge of each of the side plates 63. The upper end surfaces of the respective shutter support sections 65 are taken as upper fixed sections 66.

A lower fixing part 67 that slightly projects to the front with a rectangular shape as viewed from the top is formed in the widthwise center of the front edge of the bottom plate 64.

A shutter 68 for closing and opening the frame-side passage openings 34 is provided in the cartridge housing part 33.

As shown in FIG. 4, the shutter 68 has a substantially rectangular plate shape extending in the widthwise direction and is formed so as to have a substantially curved shape having substantially the same curvature of the curved portion of the front wall 57. The shutter 68 is formed so as to extend between the shutter guide sections 144 in the widthwise direction and to extend slightly shorter than the respective shutter guide sections 144 with respect to the vertical direction. Three shutter opening sections 69 capable of opposing the respective frame-side passage openings 34 in a one-to-one relationship are formed in the shutter 68.

The shutter 68 is disposed opposite the curved portion of the partition wall 57, and both widthwise ends of the shutter 68 are slidably sandwiched between the front wall 57 and the respective shutter guide sections 144.

As a result, the shutter 68 is supported along the respective shutter guide sections 144, in a vertically swayable manner, between an open position (see FIG. 2A) where the frame-side passage openings 34 are opened and a close position (see FIG. 4) where the frame-side passage openings 34 are closed. When the shutter 68 is in the open position, the respective frame-side passage openings 34 oppose the corresponding shutter opening sections 69, to thus become opened outside (to the front) When the shutter 68 is in the close position, the respective frame-side passage openings 34 are closed from the front by a portion of the shutter 68 that is lower than the shutter opening sections 69. In short, the shutter 68 closes the frame-side passage openings 34 by ascending action and opens the frame-side passage openings 34 by descending action.

The cartridge housing part 33 is provided with a swing arm 70. The swing arm 70 has a substantially U-shaped form as viewed from the top. The swing arm 70 integrally has a grip rod 71 extending in the widthwise direction and arm side plates 72 extending backwardly from both widthwise ends of the grip rod 71.

A boss 73 protruding outwardly in the widthwise direction is provided on a rear end portion of each of the arm side plates 72. Each of the bosses 73 is rotatably supported by a round hole 74 formed in each of the side plates 63.

An acceptance recess 75 cut so as to recede downwardly is formed in an upper side edge of a rear end portion of each of the arm side plates 72.

An upwardly-depressed grip section 76 is formed in the widthwise center of the grip rod 71. A pressing-and-projecting section 77 is provided at an either widthwise end of the grip rod 71.

While taking the bosses 73 of the respective arm side plates 72 as fulcrums, the swing arm 70 sways between a press release position (see FIGS. 4 and 5) where the lower edges of the respective arm side plates 72 come into contact with a front edge of the bottom plate 64 and a press position (see FIGS. 2 and 3) where the swing arm 70 presses the developer cartridge 31 from the front when the developer cartridge 31 is housed in the cartridge housing part 33.

(2) Developer Cartridge

As shown in FIGS. 6 through 8, the developer cartridge 31 has an inside cabinet 81 for storing the developer and an outside cabinet 82 for housing the inside cabinet 81. The inside cabinet 81 and the outside cabinet 82 function as one example of cartridge cabinet.

(2-1) Inside Cabinet

As shown in FIG. 8, the inside cabinet 81 integrally has a cylindrical inner peripheral wall 83 extending in the widthwise direction and disc-shaped inner sidewalls 84 which close both widthwise ends of the inner peripheral wall 83.

A boss section 85 that bulges in a widthwise direction and which has a thick plate disc shape is provided in the center of each of inner side walls 84.

A slide projection 86 is provided at an upper portion of each of the inner sidewall 84 and at a position which is radially outside of the boss section 85. The slide projection 86 has a substantially circular-arc shape (the shape of a circular arc having a center angle of about 60°) along an outer peripheral surface of the inner sidewall 84 as viewed sideway, as well as being provided so as to protrude from the inner sidewall 84 outwardly in the widthwise direction.

A pair of nipping projections 87 radially protrude from a peripheral end face of a rear portion of each inner sidewall 84. The pair of nipping projections 87 are disposed on a peripheral end face of each of the inner sidewalls 84 while being spaced apart from each other at an interval (corresponding to the peripheral length of the shutter 68) in the circumferential direction.

In the inner peripheral wall 83 that is enclosed by the pairs of nipping projections 87 disposed both axial ends of the inner peripheral wall 83 (i.e., the four nipping projections 87), inner passage openings 89 as one example of the cartridge-side passage openings 47 are formed in the inner peripheral wall 83.

The inner passage openings 89 are formed in an upper portion of the enclosed area 88. The inner passage openings 89 are specifically formed in number of three while being spaced apart from each other in the widthwise direction. Each of the inner passage openings 89 has a substantially rectangular shape that is elongated in the widthwise direction. Of the inner passage openings 89, the inner passage opening 89 formed in the widthwise center position is taken as an inner supply opening 90, and the inner passage openings 89 formed on both sides of the inner supply opening 90 in the widthwise direction are taken as inner return openings 91.

Slopes (called the inner slopes 79) are formed in the inner peripheral wall 83 along all of the lower edges of the respective inner passage openings 89 (the inner supply opening 90 and the inner return openings 91). As shown in FIG. 2B, the inner slopes 79 are inclined downwardly in a direction crossing the horizontal direction, more specifically, a direction from the outside of the inside cabinet 81 to the outside thereof. When a tilt angle of the inner slopes 79 with reference to a horizontal plane is specified as Y, the tilt angle Y is set so as to become greater than the foregoing repose angle of the developer.

As shown in FIG. 2A, the agitator 93 is provided within the inside cabinet 81. The agitator 93 has an agitator shaft 94 extending in the widthwise direction and agitating vanes 95 radially extending from the agitator shaft 94 to the outside. The agitator shaft 94 is rotatably supported by both inner sidewalls 84 and rotated by driving force from a motor (not shown) during operation of image forming. As mentioned above, the agitating vanes 95 also rotate, to thus agitate the developer in the developer cartridge 31

(2-2) Outside Cabinet

In order to house the inside cabinet 81 in a rotatable manner, the outside cabinet 82 is formed so as to become slightly larger than the inside cabinet 81 in both the widthwise direction and the radial direction. As shown in FIG. 6, the outside cabinet 82 integrally has a substantially cylindrical outer peripheral wall 101 extending in the widthwise direction and outer sidewalls 102 having a substantially disc shape and closing both widthwise ends of the outer peripheral wall 101.

A circular boss hole 103 for accepting the boss section 85 is formed in each of the outer sidewalls 102. Further, a slide hole 104 into which the slide projection 86 is to be inserted is formed in an upper portion of each of the outer sidewalls 102. The slide holes 104 are arranged so as to oppose the slide projections 86 in the widthwise direction. Each of the slide holes 104 has a substantially circular-arc shape, which is longer than the slide projection 86, as viewed from sideways.

A rearwardly-protruding upper fixing part 105 is formed at an upper rearward position along the peripheral end face of each of the outer sidewalls 102. A positioning boss 106 protruding to the outside in the widthwise direction is provided at a rear end portion of each upper fixing part 105.

As shown in FIG. 4, a forwardly-protruding section 107 to be pressed (hereinafter called a "press section") is provided at a lower front portion of the peripheral end face of each outer sidewall 102. The press section 107 has a substantially rectangular shape as viewed from the front and is formed, into a substantially circular-arc shape as viewed from sideway, so as to extend from the front center of each outer sidewall 102 to a lower portion thereof.

As shown in FIG. 7, four elongated holes 108 into which the pairs of nipping projections 87 (i.e., the four nipping projections 87) are to be inserted are formed at both widthwise ends of the outer peripheral wall 101. The respective elongated holes 108 are arranged so as to oppose the respective nipping projections 87 in the radial direction. Each of the elongated holes 108 has a substantially rectangular shape extending in the vertical direction as viewed from the rear and has a length equivalent to a swing range between the open position and the close position of the shutter 68.

Outer passage openings 109 as one example of outer opening constituting the cartridge-side passage openings 47 are formed between the four elongated holes 108 (i.e., a space between the two upper elongated holes 108 and the two lower elongated holes 108) on the outer peripheral wall 101.

The outer passage openings 109 are formed in number of three while being spaced apart from each other in the widthwise direction. Each of the outer passage openings 109 has a substantially rectangular shape elongated in the widthwise direction. Of the outer passage openings 109, the outer passage opening 109 formed in the widthwise center position is taken as an outer supply opening 110, and the outer passage openings 109 formed on both sides of the outer supply opening 110 in the widthwise direction are taken as outer return openings 111.

Slopes (called outer slopes 80) are formed in the inner peripheral wall 83 along all lower edges of the respective outer passage openings 109 (the outer supply opening 110 and the outer return openings 111). As shown in FIG. 2B, the outer slopes 80 are inclined downwardly in a direction crossing the horizontal direction, more specifically, a direction from the outside of the outside cabinet 82 to the outside thereof. When a tilt angle of the outer slopes 80 with reference to a horizontal plane is specified as Z, the tilt angle Z is set so as to become greater than the foregoing repose angle of the developer.

When the developer cartridge 31 is attached to the process frame 22, the outer supply opening 110 opposes the frame-side supply opening 60, and the two outer return openings 111 oppose the two frame-side return openings 61 (see FIG. 2A).

As shown in FIG. 2A, a grip section 113 is provided in the center of the front side of the outer peripheral wall 101 in the widthwise direction.

The grip section 113 has an upper grip plate 114 and a latch arm 115. The upper grip plate 114 projects from an upper side to a front side of the outer peripheral wall 101 and has a substantially rectangular shape. The latch arm 111 extends from the upper grip plate 114 downwardly and has a substantially J-shape as viewed from sideways. An upper end of the latch arm 115 is supported, in a swayable manner, by a support shaft 116 provided on the upper grip plate 114. A latch claw 117 to be latched to the lower fixing part 67 is provided on a lower end of the latch arm 115. A lower grip plate 118 projecting to the front and having a substantially rectangular shape is provided in the vicinity of the upper end of the latch arm 115. The lower grip plate 118 is arranged so as to extend in parallel to the upper grip plate 114 while being spaced apart from the upper grip plate 114.

A compression spring (not shown) for biasing the upper grip plate 114 and the lower grip plate 118 in a direction where they depart from each other is interposed between the grip plates.

(2-3) Relative Arrangement of Inside Cabinet and Outside Cabinet

The inside cabinet 81 is housed in the outside cabinet 82 in a rotatable manner. Put another way, the outside cabinet 82 and the inside cabinet 81 are relatively rotatable.

Specifically, an outer circumferential surface of the inner peripheral wall 83 is fitted to an inner circumferential surface of the outer peripheral wall 101 so as to be slidable in a circumferential direction. Although unillustrated, outer circumferential surfaces of both inner side walls 84 are fitted to inner circumferential surfaces of both outer sidewalls 102 so as to be slidable in the circumferential direction. As shown in FIGS. 6 and 71 the boss sections 85 are supported by the boss holes 103 in a rotatable manner. The slide projections 86 are inserted into the corresponding slide holes 104. The respective nipping projections 87 are inserted into the respective elongated holes 108 and project to the radial outside from the respective elongated holes 108.

While taking the boss sections 85 as fulcrums, the inside cabinet 81 is allowed to perform relative rotation with respect to the outside cabinet 82 between a close position (see FIG. 7) where the inner passage openings 89 do not oppose the outer passage openings 109 and an open position (see FIG. 6) where the inner passage openings 89 oppose the outer passage openings 109.

As shown in FIG. 7, when the inside cabinet 81 is located at the close position, the respective slide projections 86 are arranged at the front ends of the respective slide holes 104, and the respective nipping projections 87 are arranged at upper ends of the respective elongated holes 108. The inner passage openings 89 are arranged at positions higher than the outer passage openings 109, and the outer passage openings 109 are closed by a lower portion of the enclosed area 88.

While taking the boss sections 85 as fulcrums, the inside cabinet 81 is rotated relatively to the outside cabinet 82 in a direction (a downward direction) where the inner passage openings 89 move toward the outer passage openings 109. Thereupon, the respective slide protections 86 perform sliding movements within the respective slide holes 104 from the front ends to the rear ends thereof, and the respective nipping projections 87 perform sliding movements within the respective elongated holes 108 from the upper ends to the lower ends thereof.

Subsequently, when the respective slide projections 86 come into contact with the rear edges of the respective slide holes 104 and when the respective nipping projections 87 come into contact with the lower edges of the respective elongated holes 108, the inside cabinet 81 comes to the open position as shown in FIG. 6.

When the inside cabinet 81 is situated at the open position, the respective slide projections 86 are positioned at the rear ends of the respective slide holes 104, and the respective nipping projections 87 are placed at the lower ends of the respective elongated holes 108. Thus, the inner passage openings 89 oppose the outer passage openings 109, to thus open mutual communication.

When, while taking the boss sections 85 as fulcrums, the inside cabinet 81 is rotated relatively to the outside cabinet 82 in a direction where the inner passage openings 89 ascend from the outer passage openings 109 (see a solid arrow in FIG. 2B), the respective slide projections 86 come into contact with the front edges of the respective slide holes 104, and the respective nipping projections 87 come into contact with the upper edges of the respective elongated holes 108. As shown in FIG. 7, the inside cabinet 81 is put to the close position. As the inside cabinet 81 moves from the open position to the close position, the tilt angle Y of the foregoing inner slope 79 becomes greater, that is, the tilt angle of the inner slope 79 to the inner downward of the inside cabinet 81 becomes greater (see FIG. 2B).

(3) Attachment and Detachment of Developer Cartridge to and from Process Frame (3-1) Attachment of Developer Cartridge to Process Frame As shown in FIG. 4, in order to attach the developer cartridge 31 to the process frame 22, the upper grip plate 114 and the lower grip plate 118 of the grip section 113 are grasped in a direction where the upper and lower grip plates approach each other. Subsequently, the developer cartridge 31 (the inside cabinet 81 is put in the close position) is attached to the cartridge housing part 33 (the shutter 68 is placed at the close position, and the swing arm 70 is put in the press release position).

Specifically, the respective positioning bosses 106 are put on the respective upper fixing parts 66, and the pair of both widthwise nipping projections 87 (see FIGS. 6 and 7) nip upper and lower edges of both widthwise ends of the shutter 68. The respective slide projections 86 are fitted into the respective acceptance recess sections 75.

Subsequently, grasping of the grip section 113 is released, whereupon the latch claw 117 is latched to the lower fixing part 67 (see FIG. 2A), and the developer cartridge 31 is housed in the cartridge housing part 33.

Since the positioning bosses 106 are put on the upper fixing parts 66 and the latch claw 117 is engaged with the lower fixing part 67, the outside cabinet 82 is fixed to the cartridge housing part 33. As a result, attachment of the developer cartridge 31 to the process frame 22 is completed.

The swing arm 70 is swayed from the press release position to the press position. As shown in FIGS. 2A and 3, the respective pressing and projecting sections 77 press the respective press sections 107 in the rearward direction. As a result, the developer cartridge 31 is pressed toward the developing part 32.

As a result of the swing arm 70 being swayed from the press release position to the press position, the respective slide projections 86 fitted to the respective acceptance recess sections 75 perform rearward sliding movements within the respective slide holes 104 along with swaying action of the respective side plate arms 72, to thus come to the rear ends of the respective slide holes 104. Further, the pair of nipping projections 87 provided at both ends in the widthwise direction perform downward sliding movements within the respective elongated holes 108 while holding the shutter 68, to thus come to the lower ends of the respective elongated holes 108 (see FIG. 6).

As shown in FIG. 2A, the inside cabinet 81 is put in the open position, so that the inner passage openings 89 oppose the outer passage openings 109, to thus establish mutual communication. Moreover, the shutter 68 is put at the open position, and the frame-side passage openings 34 oppose the cartridge-side passage openings 47 (the inner passage openings 89 and the outer passage openings 109) in the horizontal direction, to thus establish mutual communication.

During operation of image forming, the developer in the inside cabinet 81 is supplied from the inner supply opening 90 and the outer supply opening 110 toward the developing part 32 by agitating action of the agitator 93, and the developer is accepted in the developing part 32 by way of the frame-side supply opening 60 (see FIGS. 5 and 6).

In the meantime, the developer supplied to the inside of the developing part 32 by way of the frame-side supply opening 60 is conveyed from the center position to both sides in the widthwise direction by the auger 35, to thus be supplied to the supply roller 36 in midstream. The developer supplied to the supply roller 36 is supplied to the developing roller 37 as mentioned above. In contrast, the developer that is not supplied to the supply roller 36 is conveyed to the frame-side return openings 61 and returned from the developing part 32 to the inside of the inside cabinet 81 by passing the outer return openings 111 and the inner return openings 91. Thereby, the developer is circulated between the developing part 32 and the inside cabinet 81 (see FIGS. 5 and 6).

(3-2) Detachment of Developer Cartridge from Process Frame

In order to detach the developer cartridge 31 from the process frame 22, the swing arm 70 is first swayed from the press position to the press release position. Thereupon, the respective pressing-and-projecting sections 77 depart from the respective press sections 107, thereby releasing the developing part 32 of the developer cartridge 31 from a pressed state.

Moreover, when the swing arm 70 is swayed from the press position to the press release position, the respective slide projections 86 fitted into the respective acceptance recess sections 75 perform forward sliding movements within the respective slide holes 104 along with swaying action of the respective side plate arms 72, to thus come to the front ends of the respective slide holes 104 (see FIG. 7). Further, the pair of nipping projections 87 provided at both widthwise ends perform upward sliding movements within the respective elongated holes 108 while nipping the shutter 68, to thus be arranged at the upper ends of the respective elongated holes 108 (see FIG. 7).

As a result, the inside cabinet 81 is put at the close position, and the lower portion of the enclosed area 88 opposes the outer passage openings 109, thereby closing the outer passage openings 109. The shutter 68 is placed at the close position, and the frame-side passage openings 34 oppose the shutter 68, to thus become closed (see FIG. 4).

When the upper grip plate 114 and the lower grip plate 118 of the grip section 113 are grasped in the direction where they approach each other, the latch claw 117 is disengaged from the upper fixing part 66. Accordingly, so long as the developer cartridge 31 is pulled forwardly from the cartridge housing part 33 in the disengaged state, the developer cartridge 31 is detached from the process frame 22 (see FIG. 4).

As shown in FIG. 2, the developer cartridge 31 can be realized as a double structure including the outside cabinet 82 in which the outer passage openings 109 is formed and the inside cabinet 81 in which the inner passage openings 89 capable of opposing the outer passage openings 109 are formed and which stores the developer. Moreover, the developer can be caused to move to the inside and outside of the outside cabinet 82 and the inside cabinet 81 by way of the outer passage openings 109 and the inner passage openings 89 by the outer passage openings 109 to oppose the inner passage openings 89.

The outer slopes 80, which are inclined in the direction crossing the horizontal direction when the outer passage openings 109 are oriented in the horizontal direction, are formed at the respective lower edges of the outer passage openings 109. Moreover, the inner slopes 79, which are inclined in the direction crossing the horizontal direction when the inner passage openings 89 are oriented in the horizontal direction, are formed at the respective lower edges of the inner passage openings 89.

As a result, the developer moves along the corresponding outer slopes 80 and inner slopes 79 at the respective lower edges of the outer passage openings 109 and the inner passage openings 89, so that the developer does not stay at the respective lower edges of the outer passage openings 109 and the inner passage openings 89. Thus, leakage of the developer can be prevented reliably.

The inside cabinet 81 is rotatable with respect to the outside cabinet 82, and the inner slopes 79 of the inside cabinet 81 are inclined downwardly from the outside to the inside. As a result, when the inside cabinet 81 is rotated with respect to the outside cabinet 82, the developer moves at the lower edges of the inner passage openings 89 to the inside of the inside cabinet 81 along the inner slopes 79. Therefore, the developer does not stay at the lower edges of the inner passage openings 89 or a space between the inside cabinet 81 and the outside cabinet 82, thereby preventing leakage of the developer reliably.

The outer slopes 80 of the outside cabinet 82 are inclined downwardly from the inside to the outside. In a state where the outer passage openings 109 and the inner passage openings 89 oppose each other along the horizontal direction, front edges (upper edges) of the outer slopes 80 and rear edges (upper edges) of the inner slopes 79 become continuous. The outer slopes 80 and the inner slopes 79 constitute upwardly-tapered triangular shapes when viewed from sideways (see FIG. 2A). Therefore, the developer reliably moves to the outside of the outside cabinet 82 along the outer slopes 80 and also moves to the inside of the inside cabinet 81 without fail.

As shown in FIG. 2B, as the inside cabinet 81 is rotated in the direction in which the inner passage openings 89 ascend from the outer passage openings 109, to thus close the outer passage openings 109, the inclination of the inner slopes 79 to the inner downward direction with reference to the horizontal direction becomes greater (the tilt angle Y becomes greater). Accordingly, the developer can be caused to move from the lower edges of the inner passage openings 89 to the inside of the inside cabinet 81. Therefore, leakage of the developer can be prevented more thoroughly.

The tilt angle Y of the inner slopes 79 with respect to the horizontal plane and the tilt angle Z of the outer slopes 80 with respect to the horizontal plane are greater than the angle of repose of the developer. Therefore, the developer reliably moves along the corresponding inner slopes 79 and outer slopes 80 at the respective lower edges of the inner passage openings 89 and outer passage openings 109. Accordingly, the developer does not stay at the respective lower edges of the inner passage openings 89 and the outer passage openings 109, and leakage of the developer can be prevented more thoroughly.

The frame-side slopes 78, which are inclined downwardly with respect to the horizontal direction from the outside to the inside when the frame-side passage openings 34 are oriented in the horizontal direction, are formed at the respective lower edges of the frame-side passage openings 34. The developer therefore moves to the inside of the process frame 22 along the frame-side slopes 78 at the frame-side passage openings 34, so that the developer does not stay at the respective lower edges of the frame-side passage openings 34 or a space between the process frame 22 and the developer cartridge 31. Thus, leakage of the developer can be prevented reliably.

As mentioned above, the shutter 68 closes the frame-side passage openings 34 by ascending action. Accordingly, at the time of operation for closing the frame-side passage openings 34, movement of the developer to the outside is hindered at the lower edges of the frame-side passage openings 34, so that leakage of the developer can be prevented reliably.

The tilt angle X of the frame-side slopes 78 with respect to the horizontal plane is greater than the angle of repose of the developer. Therefore, the developer reliably moves to the inside of the process frame 22 along the frame-side slopes 78 at the lower edges of the frame-side passage openings 34. Hence, the developer does not stay at the lower edges of the frame-side passage openings 34 and the space between the process frame 22 and the developer cartridge 31, and leakage of the developer can be prevented more thoroughly.

As shown in FIG. 2A, in a state where the developer cartridge 31 is attached to the process frame 22, the cartridge-side passage openings 47 (the outer passage openings 109 and the inner passage openings 89) and the frame-side passage openings 34 oppose each other along the horizontal direction. As a result, the inner slopes 79, the outer slopes 80, and the frame-side slopes 78 are inclined without fail in a direction crossing the horizontal direction. Accordingly, the developer moves along the corresponding inner slopes 79, the outer slopes 80, and the frame-side slopes 78 at the respective lower edges of the cartridges-side passage openings 47 and the frame-side passage openings 34. Therefore, the developer does not stay at the lower edges of the cartridge-side passage openings 47 and the frame-side passage openings 34, and leakage of the developer can be prevented more thoroughly.

In a state where the cartridge-side passage openings 47 and the frame-side passage openings 34 oppose each other along the horizontal direction, rear edges (lower edges) of the outer slopes 80 and front edges (upper edges) of the frame-side slopes 78 are continuous with the shutter opening sections 69 of the shutter 68 sandwiched therebetween. Therefore, the developer moved to the outside of the outside cabinet 82 along the outer slopes 80 smoothly reaches the frame-side slopes 78 and reliably moves to the inside (in the developing part 32) of the process frame 22. Incidentally, when slopes continuous to the outer slopes 80 and the frame-side slopes 78 are formed at the lower edges of the shutter opening sections 69 of the shutter 68, the developer moving from the outer slopes 80 can be caused to reach the frame-side slopes 78 more smoothly.

MODIFIED EXAMPLES

(1) Modified Examples of Inside Cabinet and Outside Cabinet

In the above-described aspects, the inside cabinet 81 is rotatable relatively to the outside cabinet 82. In contrast, the outside cabinet 82 may also be rotatable relatively to the inside cabinet 81.

The inside cabinet 81 and the outside cabinet 82 of that case will be described hereunder.

Figures 9A, 9B:
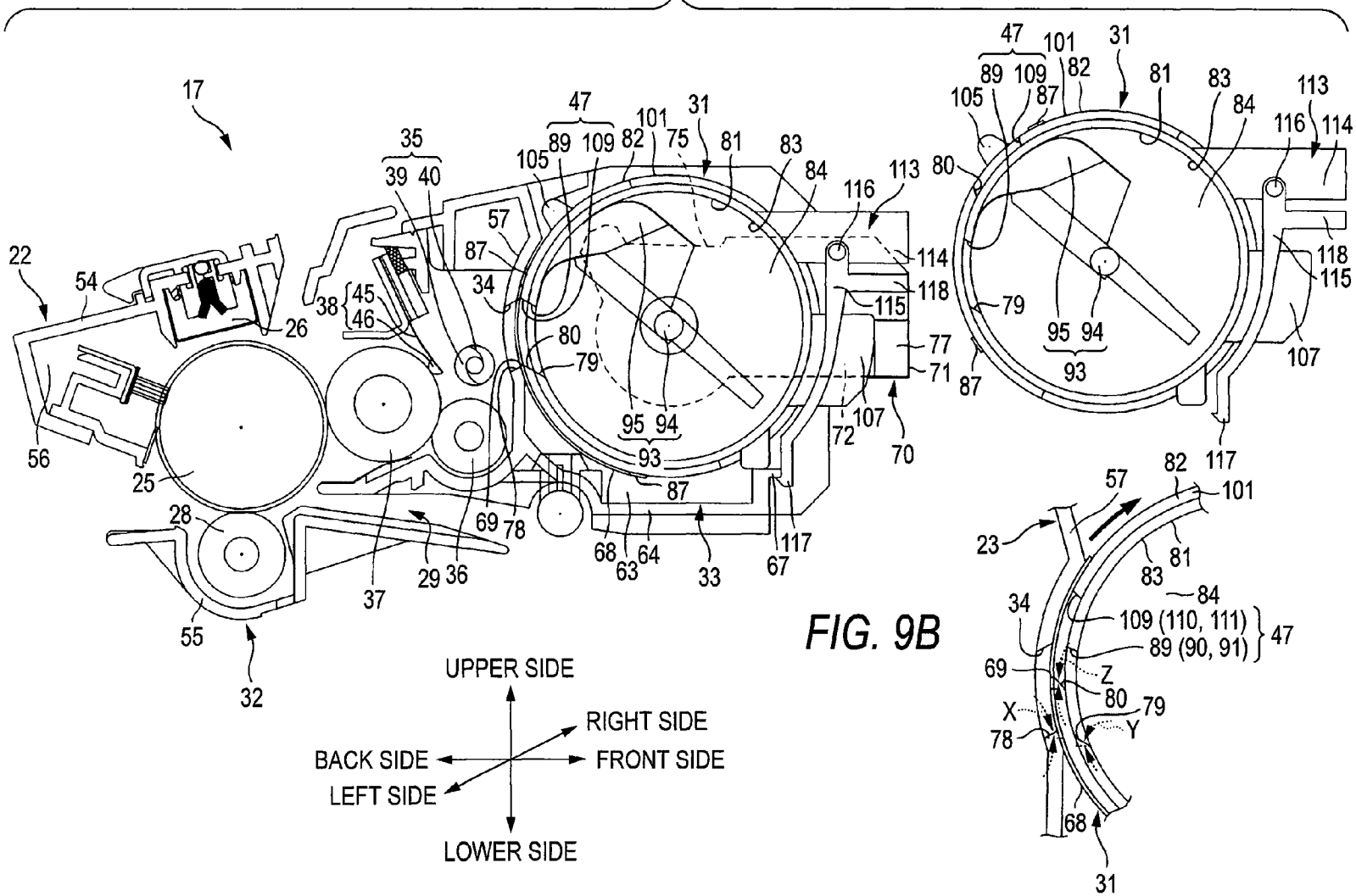
FIGS. 9A and 9B show a modified example of a developing unit and a developer cartridge shown in FIGS. 2A and 2B.
Figure 10:
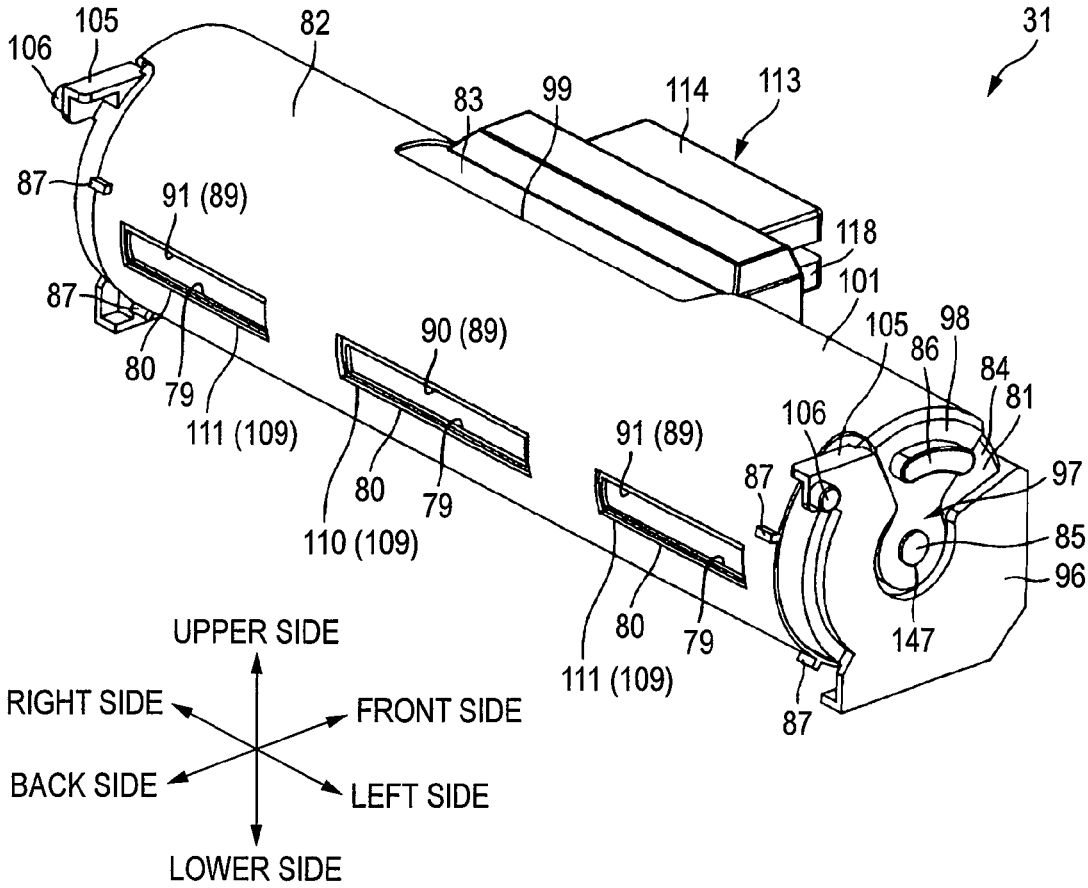
FIG. 10 is an exemplary perspective view of the developer cartridge of FIG. 9, as viewed from a back left side, in a state in which an outside cabinet is in an opened position.
Figure 12:
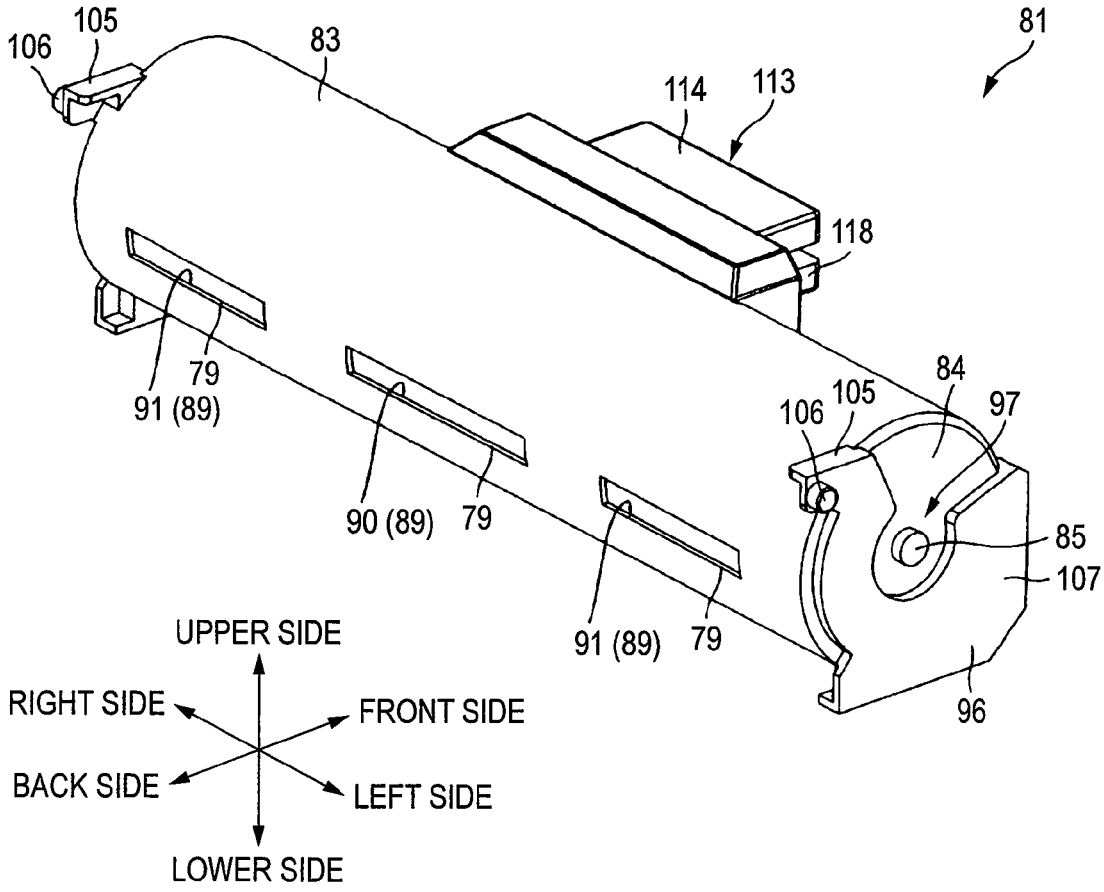
FIG. 12 is an exemplary perspective view, as viewed from a back left side, of the inside cabinet of the developer cartridge of FIG. 10.
Figure 13:
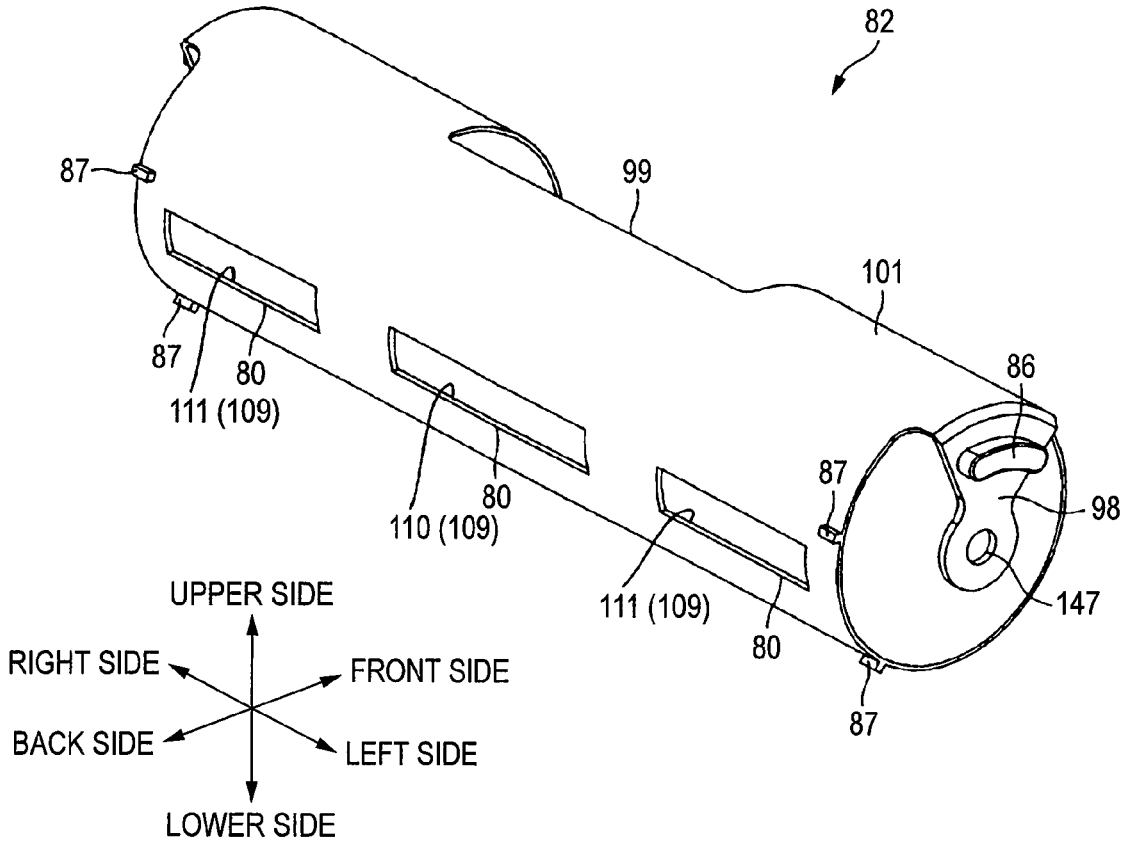
FIG. 13 is an exemplary perspective view, as viewed from a back left side, of the outside cabinet of the developer cartridge of FIG. 10.

FIGS. 9A and 9B show a modified example of a developing unit and a developer cartridge shown in FIGS. 2A and 2B. FIG. 10 is an exemplary perspective view of the developer cartridge of FIG. 9, as viewed from a back left side, in a state in which an outside cabinet is in an opened position. FIG. 11 is an exemplary perspective view of the developer cartridge of FIG. 9, as viewed from the back left side, in a state in which the outside cabinet is in a closed position. FIG. 12 is an exemplary perspective view, as viewed from a back left side, of the inside cabinet of the developer cartridge of FIG. 10. FIG. 13 is an exemplary perspective view, as viewed from a back left side, of the outside cabinet of the developer cartridge of FIG. 10.

(1-1) Inside Cabinet

By reference to FIG. 12, the inside cabinet 81 integrally has the above-described inner peripheral wall 82 and the inner sidewalls 84. The boss section 85 provided in the center of each of the inner sidewalls 84 has a substantially cylindrical shape differing from the foregoing thick disc-shaped geometry.

The slide projection 86 is not provided on each of the inner sidewalls 84, and the nipping projection 87 is provided along a peripheral end face of each of the inner sidewall 84.

In the meantime, a developer inner plate 96 is integrally provided on a widthwise outer side surface of each of the inner sidewalls 84. The developer inner plate 96 substantially assumes the shape of the letter U when viewed from sideways, and an inner portion of the letter U (i.e., an inner portion 97) is formed so as to become deep downwardly in an oblique rear direction. The deepest portion of each of the inner portion 97 has a substantially circular shape, and the boss section 85 is placed at the center of the circular shape. When viewed from sideways, the inner portions 97 are formed so as to spread into the shape of a fan from the deepest portion to an obliquely upward and forward direction.

The upper fixing part 105 and the positioning boss 106 are provided at a rear upper portion of each of the developer inner plates 96, and a front end portion of each of the inner inner plates 96 forms the above-described press section 107.

The above-described grip section 113 is provided at a position on a side (the front side) opposite to the inner passage opening 89 corresponding to the center of the inner peripheral wall 83.

As in the case of the above-described example, the inner slopes 79 that are downwardly inclined from the outside to the inside of the inside cabinet 81 are formed at the respective lower edges of the inner passage openings 89 of the inner peripheral wall 83.

(1-2) Outside Cabinet

In response to the inside cabinet 81 of the modification, the outside cabinet 82 is also different from that described in connection with the above-described aspect.

Referring to FIG. 13, the outside cabinet 82 of the modification is not provided with the outer sidewalls 102, and both widthwise ends of the outer peripheral wall 101 are opened to the outside in the widthwise direction. The above-described pair of nipping projections 87 (the four nipping projections 87) is provided at either widthwise end of the outer peripheral wall 101, and the outer passage openings 109 are formed within the area on the outer peripheral wall 101 surrounded by the nipping projections 87. The elongated holes 108 are not provided in the outer peripheral wall 101 in response to the nipping projections 87. In the meantime, an exposure hole 99 for uncovering the above-described grip section 113 is formed in a position on a side (front side) opposite to the outer passage opening 109 corresponding to the center of the outer peripheral wall 101.

In the meantime, developer outer plates 98 are integrally provided at the positions that deviate clockwise from the outer passage openings 109 through about 90° when viewed from the left. The respective developer outer plates 98 extend from both widthwise ends of the outer peripheral wall 101 to the radially inside of the outer peripheral wall 101. When viewed from the side, the developer outer plates 98 have a substantially triangular shape which becomes narrower toward the radial inside thereof. A circular hole (a fitting hole 147) is formed in the position of each developer outer plate 98 corresponding to the center of the circle of the outer peripheral wall 101. The above-described slide projection 86 is provided at a position on each developer outer plate close to the outer peripheral wall 101.

Even in the modification, the outer slopes 80 are formed at the lower edges of the respective outer passage openings 109 in the outer peripheral wall 101. The outer slopes 80 of the modification are downwardly inclined from the outside to the inside of the outside cabinet 82 (see FIG. 9). As in the case of the above-described aspect, the tilt angle Z of the outer slope 80 is set so as to become greater than the angle of repose of the developer (see FIG. 95).

(1-3) Relative Arrangement Between Inside Cabinet and Outside Cabinet

As in the above-described aspect, the inside cabinet 81 is housed in the outside cabinet 82.

Specifically, as shown in FIGS. 10 and 11, the grip section 113 is exposed through the exposure hole 99 of the outer peripheral wall 101, and the boss sections 85 are fitted into the fitting holes 147 of the respective developer outer plates 98. The respective developer outer plates 98 are situated within the inner portions 97 of the corresponding developer inner plates 96.

As a result of the boss sections 85 being fitted into the fitting holes 147, the outside cabinet 82 is allowed to perform relative rotatable movement around the boss sections 85 with respect to the inside cabinet 81 between the close position (see FIG. 11) and the open position (see FIG. 10).

As shown in FIG. 11, when the outside cabinet 82 is situated at the close position, the outer passage openings 109 are situated at positions higher than the inner passage openings 89, and the inner passage openings 89 are closed by a portion of the outer peripheral wall 101 that is lower than the outer passage openings 109.

While taking the boss sections 85 as fulcrums, the outside cabinet 82 is rotated relatively to the inside cabinet 81 in a direction (downward direction) in which the outer passage openings 109 face the inner passage openings 89.

Subsequently, when the respective developer outer plates 98 come into contact with rear edges of the corresponding inner portions 97, the outside cabinet 82 is placed at the open position, as shown in FIG. 10.

When the outside cabinet 82 is situated at the open position, the inner passage openings 89 oppose the outer passage openings 109, such that they come into mutual communication and are opened.

When the outside cabinet 82 is rotated relatively to the inside cabinet 81, while taking the boss sections 85 as fulcrums, in a direction where the outer passage openings 109 ascend from the inner passage openings 89 (see a thick arrow in FIG. 9B), the respective developer outer plates 98 come into contact with the front edges of the corresponding inner portions 97, whereupon the outside cabinet 82 is put in the close position.

The tilt angle Z of the outer slopes 80, that is, the downward inclination of the outer slopes 80 to the inside of the outside cabinet 82, becomes greater as the outside cabinet 82 moves from the open position to the close position (see FIG. 9B).

When the developer cartridge 31 of the modification is attached to the process frame 22, the positioning bosses 106 are placed on the respective upper fixing parts 66, and the latch claws 117 are latched to the lower fixing parts 67, whereby the inside cabinet 81 is fixed to the cartridge housing part 33 (see FIG. 9A).

When the swing arm 70 is swayed from the press release position to the press position, the respective slide projections 86 fitted into the respective acceptance recess sections 75 slide rearwardly in conjunction with rotatable movement of the respective arm side plates 72, and the pair of nipping projections 87 provided at both widthwise ends slide downwardly while nipping the shutter 68.

As a result, the outside cabinet 82 is placed at the open position (see FIG. 10) and the outer passage openings 109 oppose the inner passage openings 89 as shown in FIG. 9A, whereby they are brought into mutual communication. Moreover, the shutter 68 is placed at the open position, and the frame-side passage openings 34 oppose the cartridge-side passage openings 47 (the inner passage openings 89 and the outer passage openings 109) in the horizontal direction, whereby they are brought into mutual communication.

In the meantime, the swing arm 70 is swayed from the press position to the press release position, thereby releasing the inside cabinet 81 from the cartridge housing part 33. Further, the developer cartridge 31 is pulled forwardly from the cartridge housing part 33, whereupon the developer cartridge 31 is detached from the process frame 22.

As shown in FIG. 9, in the modification, the outside cabinet 82 can rotate with respect to the inside cabinet 81, and the outer slopes 80 of the outside cabinet 82 are downwardly inclined from the outside to the inside.

As a result, when the outside cabinet 82 rotates with respect to the inside cabinet 81, the developer moves to the inside of the outside cabinet 82 along the outer slopes 80 at the lower edges of the outer passage openings 109. That is, the developer moves to the inner passage openings 89. As mentioned above, the inner slopes 79 of the inside cabinet 81 are also inclined downwardly from the outside to the inside, and hence the developer moves to the inside of the inside cabinet 81 along the inner slopes 79 at the lower edges of the inner passage openings 89.

Consequently, the developer moves to the inside of the inside cabinet 81 along the corresponding outer slopes 80 and the inner slopes 79 at the respective lower edges of the outer passage openings 109 and those of the inner passage openings 89. Since the developer located at the lower edges of the outer passage openings 109 and the lower edges of the inner passage openings 89 is brought into the inside, leakage of the developer can be prevented reliably.

As shown in FIG. 9A, in a state where the outer passage openings 109 and the inner passage openings 89 oppose each other in the horizontal direction, the front edges (lower edges) of the outer slopes 80 and the rear edges (upper edges) of the inner slopes 79 are continuous. Therefore, the developer located on the outer slopes 80 smoothly reach the inner slopes 79, to thus move to the inside of the inside cabinet 81 reliably.

As shown in FIG. 9B, the downward inclination of the outer slopes 80 of the outside cabinet 82 to the inside with reference to the horizontal direction becomes greater (the tilt angle Z becomes greater) as the outside cabinet 82 rotates in the direction where the outer passage openings 109 ascend from the inner passage openings 89, to thus close the inner passage openings 89. As a result, the developer can be caused to move from the lower edges of the outer passage openings 109 to the inside of the internal housing 81 reliably. Therefore, leakage of the developer can be prevented more thoroughly.

In the above-described aspects, the developing unit 17 integrally has the photosensitive drum 25 and the developing roller 37, and the developing unit 17 is detachably attached to the body casing 2. In addition, for example, the developing unit 17 may also be embodied as a developing cartridge not having the photosensitive drum 25, and another unit (a drum cartridge) having the photosensitive drum 25 may be provided, and the developing cartridge may be detachably attached to the drum cartridges. Moreover, there may also be adopted a configuration in which only the developer cartridge 31 is detachably attached while the developing unit 17 remains attached to the body casing 2.

(2) Additional Modified Examples

In addition to the above-described modified example of the outer slopes 80, which are inclined downwardly from the outside to the inside of the outside cabinet 82, the inside cabinet 81 may also rotate in the direction where the inner passage openings 89 descend from the outer passage openings 109 in order to close the outer passage openings 109. That is, in contrast with the above-described modified example, the inside cabinet 81 rotates with respect to the outside cabinet 82.

In this case, when the inside cabinet 81 closes the outer passage openings 109, the inner passage openings 89 descend from the outer passage openings 109. Hence, the developer can be moved from the lower edges of the outer passage openings 109 to the inner passage openings 89 without fail. Moreover, when the inside cabinet 81 rotates with respect to the outside cabinet 82, the developer moves to the inside of the inside cabinet 81 along the inner slopes 79 at the lower edges of the inner passage openings 89. Therefore, leakage of the developer can be prevented more thoroughly.

Further, the body casing 2 may include the photosensitive drum 25, the scorotron-type charger 26, and the transfer roller 28, and the developing cartridge can also be detachably attached to the body casing 2.

Still further, although aspects of the present inventive concept have been described in relation to a laser printer, the present inventive concept is not limited to a monochrome laser printer. Rather, the present inventive concept can also be applied to a color laser printer, including a tandem type and an intermediate transfer type printer.

What is claimed is:

1. A developer cartridge comprising:

a cartridge cabinet configured to accommodate developer, the cartridge cabinet comprising:

a cartridge-side opening that allows communication between an inside of the cartridge cabinet and an outside of the cartridge cabinet;

a slope provided at a lower edge of the cartridge-side opening, the slope inclining in a direction crossing a horizontal direction when the cartridge-side opening is oriented in a horizontal direction;

an outside cabinet comprising an outer opening that allows communication between an inside of the outside cabinet and an outside of the outside cabinet; and an inside cabinet that is housed in the outside cabinet and is configured to accommodate the developer, the inside cabinet comprising an inside opening that is locatable in a position opposed to the outside opening, wherein the cartridge-side opening includes the outside opening and the inside opening, and wherein the slope is provided at a lower edge of the outside opening in the outside cabinet and at a lower edge of the inside opening in the inside cabinet.

2. The developer cartridge according to claim 1, wherein a tilt angle of the slope with respect to a horizontal plane is greater than an angle of repose of the developer.

3. The developer cartridge according to claim 1, wherein the inside cabinet is rotatable with respect to the outside cabinet, wherein the slope provided at the lower edge of the outside opening is inclined downwardly from the inside of the outside cabinet to the outside of the outside cabinet, and wherein the slope formed at the lower edge of the inside opening is downwardly inclined from the outside of the inside cabinet to the inside of the inside cabinet.

4. The developer cartridge according to claim 3, wherein, when the outside opening is oriented in the horizontal direction, the inside cabinet rotates in a direction where the inside opening ascends from the outside opening so as to close the outside opening.

5. The developer cartridge according to claim 1, wherein the outside cabinet and the inside cabinet are rotatable relatively to each other, wherein the slope provided at the lower edge of the outside opening is inclined downwardly from the outside of the outside cabinet to the inside of the outside cabinet, and wherein the slope provided at the lower edge of the inside opening is inclined downwardly from the outside of the inside cabinet to the inside of the inside cabinet.

6. The developer cartridge according to claim 5, wherein, when the inside opening is oriented in the horizontal direction, the outside cabinet rotates in a direction where the outside opening ascends from the inside opening so as to close the inside opening.

7. The developer cartridge according to claim 5, wherein, when the outside opening is oriented in the horizontal direction, the inside cabinet rotates in a direction where the inside opening descends from the outside opening so as to close the outside opening.

8. A developing device comprising:

a developer cartridge comprising:

a cartridge cabinet configured to accommodate developer, the cartridge cabinet comprising:

a cartridge-side opening that allows communication between an inside of the cartridge cabinet and an outside of the cartridge cabinet;

a slope provided at a lower edge of the cartridge-side opening, the slope inclining in a direction crossing a horizontal direction when the cartridge-side opening is oriented in a horizontal direction;

an outside cabinet comprising an outer opening that allows communication between an inside of the outside cabinet and an outside of the outside cabinet; and an inside cabinet that is housed in the outside cabinet and is configured to accommodate the developer, the inside cabinet comprising an inside opening that is locatable in a position opposed to the outside opening, wherein the cartridge-side opening includes the outside opening and the inside opening, and wherein the slope is provided at a lower edge of the outside opening in the outside cabinet and at a lower edge of the inside opening in the inside cabinet;

a developing cabinet, the developer cartridge being detachably attached to the developing cabinet, the developing cabinet comprising a developing-side opening located in a position opposed to the cartridge-side opening and configured to receive the developer;

an open/close member that is operable to:

close the developing-side opening by ascending operation; and open the developing-side opening by descending operation; and a developer carrier that is supported by the developing cabinet and carries the developer to a photosensitive member, wherein the developing cabinet further comprises a slope at a lower edge of the developing-side opening, the slope inclining downwardly from an outside of the developing cabinet to an inside of the developing cabinet with respect to a horizontal direction when the developing-side opening is oriented in the horizontal direction.

9. The developing device according to claim 8, wherein a tilt angle of the slope with respect to a horizontal plane is greater than an angle of repose of the developer.

10. The developing device according to claim 8, wherein the cartridge-side opening is locatable in a position opposed to the developing-side opening along the horizontal direction when the developer cartridge is attached to the developing cabinet.

11. A developing device comprising:

a developer cartridge comprising:

a cartridge cabinet configured to accommodate developer, the cartridge cabinet comprising:

a cartridge-side opening that allows communication between an inside of the cartridge cabinet and an outside of the cartridge cabinet;

a slope provided at a lower edge of the cartridge-side opening, the slope inclining in a direction crossing a horizontal direction when the cartridge-side opening is oriented in a horizontal direction;

an outside cabinet comprising an outer opening that allows communication between an inside of the outside cabinet and an outside of the outside cabinet; and an inside cabinet that is housed in the outside cabinet and is configured to accommodate the developer, the inside cabinet comprising an inside opening that is locatable in a position opposed to the outside opening, wherein the cartridge-side opening includes the outside opening and the inside opening, and wherein the slope is provided at a lower edge of the outside opening in the outside cabinet and at a lower edge of the inside opening in the inside cabinet;

a developing cabinet comprising a developing-side opening that is locatable in a position opposed to the cartridge-side opening and is configured to receive the developer from the cartridge-side opening; and a developer carrier that is supported by the developing cabinet and carries the developer to a photosensitive member.

12. A developing device comprising:

a developer cartridge including a cartridge cabinet configured to accommodate developer, the cartridge cabinet comprising:

a cartridge-side opening that allows communication between an inside of the cartridge cabinet and an outside of the cartridge cabinet; and a slope provided at a lower edge of the cartridge-side opening, the slope inclining in a direction crossing a horizontal direction when the cartridge-side opening is oriented in a horizontal direction;

an outside cabinet comprising an outer opening that allows communication between an inside of the outside cabinet and an outside of the outside cabinet; and an inside cabinet that is housed in the outside cabinet and is configured to accommodate the developer, the inside cabinet comprising an inside opening that is locatable in a position opposed to the outside opening, wherein the cartridge-side opening includes the outside opening and the inside opening, and wherein the slope is provided at a lower edge of the outside opening in the outside cabinet and at a lower edge of the inside opening in the inside cabinet;

a cartridge housing part to which the developer cartridge is detachably attached;

a developing cabinet comprising a developing-side opening configured to receive developer supplied from the developer cartridge;

an open/close member that is operable to:

close the developing-side opening by ascending operation; and open the developing-side opening by descending operation;

a developer carrier that is supported by the developing cabinet and is configured to supply the developer to a photosensitive member; and a slope provided at a lower edge of the developing-side opening, the slope inclining downwardly with respect to a horizontal direction from an outside of the developing cabinet to an inside of the developing cabinet when the developing-side opening is oriented in the horizontal direction.

* * * * *